US008685488B2

(12) United States Patent
Hoffmuller et al.

(10) Patent No.: US 8,685,488 B2
(45) Date of Patent: Apr. 1, 2014

(54) METHOD FOR PRODUCING A MICROSTRUCTURE

(75) Inventors: Winfried Hoffmuller, Bad Tolz (DE); Theodor Burchard, Gmund (DE); Marius Dichtl, Munich (DE); Patrick Renner, Reichersbeuern (DE); Michael Rahm, Hemau (DE); Manfred Heim, Bad Tolz (DE); Lars Hoffmann, Freising (DE); Manfred Dotzler, Lenggries (DE); Ralf Liebler, Schliersee (DE); Mario Keller, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 358 days.

(21) Appl. No.: 12/809,909

(22) PCT Filed: Dec. 17, 2008

(86) PCT No.: PCT/EP2008/010739

§ 371 (c)(1),
(2), (4) Date: Jun. 21, 2010

(87) PCT Pub. No.: WO2009/083146

PCT Pub. Date: Jul. 9, 2009

(65) Prior Publication Data

US 2011/0045248 A1 Feb. 24, 2011

(30) Foreign Application Priority Data

Dec. 21, 2007 (DE) ..... 10 2007 062 089

(51) Int. Cl.
*B41M 3/14* (2006.01)
*B44F 1/12* (2006.01)

(52) U.S. Cl.
USPC ..... 427/7

(58) Field of Classification Search
USPC ..... 427/7
See application file for complete search history.

(56) References Cited

U.S. PATENT DOCUMENTS 1,475,430 A 11/1923 Curwen
4,921,319 A 5/1990 Mallik (Continued)

FOREIGN PATENT DOCUMENTS

DE 3602563 C1 4/1987
DE 19949542 A1 4/2001

(Continued)

OTHER PUBLICATIONS

Durand F., Photography—Reversible Prints, Integral Photographs, (English translation of article by Lippman), Academy of the Sciences, Mar. 2, 1908 session, 4 pages.

(Continued)

*Primary Examiner* — Kelly M Gambetta
(74) *Attorney, Agent, or Firm* — Lathrop & Gage LLP

(57) ABSTRACT

The present invention relates to a method for producing a micropattern on a substrate (22), in which a substrate (22) is provided with a relief pattern (26, 28) that exhibits elevations (26) and depressions (28), and in which the elevations (26) and/or depressions (26) are arranged in the form of the desired micropattern, and with a printing tool, an imprint material (30; 34) is transferred to the relief pattern (26, 28), the viscosity of the imprint material (30; 34) being chosen such that the imprint material (30; 34) is selectively transferred either substantially only onto the elevations (26) or substantially only into the depressions (28) of the relief pattern.

41 Claims, 14 Drawing Sheets

(56) References Cited

U.S. PATENT DOCUMENTS

Figure 1:
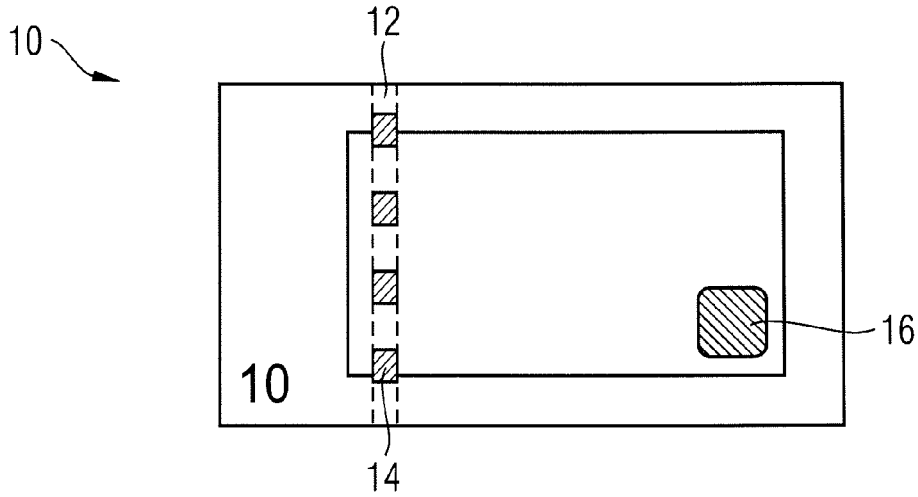

| | | | | |
|---|---|---|---|---|
| 5,538,753 | A | 7/1996 | Antes et al. | |
| 5,712,731 | A | 1/1998 | Drinkwater et al. | |
| 5,723,200 | A | 3/1998 | Oshima et al. | |
| 5,772,250 | A | 6/1998 | Gasper | |
| 5,830,609 | A * | 11/1998 | Warner et al. | 430/10 |
| 6,288,842 | B1 | 9/2001 | Florczak et al. | |
| 6,329,040 | B1 | 12/2001 | Oshima et al. | |
| 6,995,383 | B2 | 2/2006 | Wilson et al. | |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 8,100,436 | B2 * | 1/2012 | Heine et al. | 283/72 |
| 8,149,511 | B2 | 4/2012 | Kaule | |
| 2004/0262909 | A1 | 12/2004 | Bauer et al. | |
| 2005/0151368 | A1 * | 7/2005 | Heim | 283/72 |
| 2006/0003295 | A1 | 1/2006 | Hersch et al. | |
| 2007/0165182 | A1 | 7/2007 | Hoffmuller | |
| 2007/0177131 | A1 | 8/2007 | Hansen | |
| 2007/0211238 | A1 | 9/2007 | Hoffmuller | |
| 2007/0216518 | A1 | 9/2007 | Hoffmuller | |
| 2007/0229263 | A1 | 10/2007 | Staub et al. | |
| 2007/0229928 | A1 | 10/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0037131 | A1 | 2/2008 | Steenblik et al. | |
| 2008/0050660 | A1 | 2/2008 | Staub et al. | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule et al. | |
| 2008/0163994 | A1 | 7/2008 | Hoppe | |
| 2008/0182084 | A1 | 7/2008 | Tompkin et al. | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2008/0259416 | A1 | 10/2008 | Peters et al. | |
| 2008/0310025 | A1 | 12/2008 | Staub et al. | |
| 2009/0001709 | A1 | 1/2009 | Kretschmar | |
| 2009/0008923 | A1 | 1/2009 | Kaule et al. | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0218397 | A1 | 9/2009 | Wild et al. | |
| 2009/0236061 | A1 | 9/2009 | Gruszczynski | |
| 2009/0290221 | A1 | 11/2009 | Hansen et al. | |
| 2009/0297805 | A1 | 12/2009 | Dichtl | |
| 2009/0322071 | A1 | 12/2009 | Dichtl | |
| 2010/0175843 | A1 | 7/2010 | Gregarek | |
| 2010/0177094 | A1 | 7/2010 | Kaule | |
| 2010/0182221 | A1 | 7/2010 | Kaule et al. | |
| 2010/0194091 | A1 | 8/2010 | Heim | |
| 2010/0194532 | A1 | 8/2010 | Kaule et al. | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0007374 | A1 | 1/2011 | Heim | |
| 2011/0012337 | A1 | 1/2011 | Heim | |
| 2011/0027538 | A1 | 2/2011 | Hoffmann | |
| 2011/0045248 | A1 | 2/2011 | Hoffmuller et al. | |
| 2011/0069360 | A1 | 3/2011 | Dichtl | |
| 2011/0079997 | A1 | 4/2011 | Heim | |
| 2011/0091665 | A1 | 4/2011 | Heim | |
| 2011/0095518 | A1 | 4/2011 | Hoffmuller | |
| 2011/0101670 | A1 | 5/2011 | Heim | |
| 2011/0109078 | A1 | 5/2011 | Hoffmuller | |
| 2011/0114733 | A1 | 5/2011 | Heim | |
| 2011/0157183 | A1 | 6/2011 | Kaule | |
| 2012/0126525 | A1 | 5/2012 | Dorfler | |
| 2012/0168515 | A1 | 7/2012 | Schutzmann | |
| 2012/0170124 | A1 | 7/2012 | Fuhse | |

FOREIGN PATENT DOCUMENTS

| | | | |
|---|---|---|---|
| DE | 102004007379 | B3 | 9/2005 |
| DE | 102004031879 | A1 | 1/2006 |
| DE | 102004059798 | A1 | 6/2006 |
| DE | 102005028162 | A1 | 12/2006 |
| DE | 102005052562 | A1 | 5/2007 |
| DE | 102005062132 | A1 | 7/2007 |
| DE | 102006006501 | A1 | 8/2007 |
| DE | 102005006231 | B4 | 9/2007 |
| DE | 102005006277 | B4 | 9/2007 |
| DE | 102007020026 | A1 | 11/2007 |
| DE | 102006029536 | A1 | 12/2007 |
| DE | 102006029850 | A1 | 1/2008 |
| DE | 102007029203 | A1 | 1/2009 |
| DE | 102007062089 | A1 | 7/2009 |
| EP | 0064067 | A1 | 11/1982 |
| EP | 0238043 | A2 | 9/1987 |
| EP | 0330733 | A1 | 9/1989 |
| EP | 0933407 | A1 | 8/1999 |
| EP | 0537439 | B2 | 7/2003 |
| EP | 1554700 | B1 | 1/2007 |
| EP | 1878584 | A2 | 1/2008 |
| EP | 1953002 | A2 | 1/2008 |
| GB | 2231572 | A | 11/1990 |
| GB | 2362493 | A | 11/2001 |
| JP | 10035083 | A | 2/1998 |
| JP | 2001 055000 | A | 2/2001 |
| JP | 2003 039583 | A | 3/2003 |
| JP | 2003 120500 | A | 4/2003 |
| WO | WO 94/27254 | A1 | 11/1994 |
| WO | WO 98/39163 | A2 | 9/1998 |
| WO | WO 99/13157 | A1 | 3/1999 |
| WO | WO 99/56964 | A1 | 11/1999 |
| WO | WO 03/005075 | A1 | 1/2003 |
| WO | WO 03/029019 | A1 | 4/2003 |
| WO | WO 2004/101890 | A1 | 11/2004 |
| WO | WO 2005/052650 | A2 | 6/2005 |
| WO | WO 2005/106601 | A2 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006/018232 | * | 2/2006 |
| WO | WO 2006015733 | | 2/2006 |
| WO | WO 2006018171 | | 2/2006 |
| WO | WO 2006018172 | | 2/2006 |
| WO | WO 2006/029745 | A1 | 3/2006 |
| WO | WO 2006/034780 | A1 | 4/2006 |
| WO | WO 2006040069 | | 4/2006 |
| WO | WO 2006056342 | | 6/2006 |
| WO | WO 2006072380 | | 7/2006 |
| WO | WO 2006/087138 | A1 | 8/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007/007793 | A1 | 1/2007 |
| WO | WO 2007006445 | | 1/2007 |
| WO | WO 2007006455 | | 1/2007 |
| WO | WO 2007/030530 | A2 | 3/2007 |
| WO | WO 2007/076952 | A2 | 7/2007 |
| WO | WO 2007076952 | | 7/2007 |
| WO | WO 2007079851 | | 7/2007 |
| WO | WO 2007/087984 | A1 | 8/2007 |
| WO | WO 2007/113640 | A2 | 10/2007 |
| WO | WO 2007115648 | | 10/2007 |
| WO | WO 2007/131765 | A2 | 11/2007 |
| WO | WO 2007/137744 | A2 | 12/2007 |
| WO | WO 2008/000350 | | 1/2008 |
| WO | WO 2008/000350 | A1 | 1/2008 |
| WO | WO 2008/000351 | | 1/2008 |

(56) References Cited

FOREIGN PATENT DOCUMENTS

| | | | |
|---|---|---|---|
| WO | WO 2008/000351 | A2 | 1/2008 |
| WO | WO 2008/049533 | | 5/2008 |
| WO | WO 2008/061636 | | 5/2008 |
| WO | WO 2008/071325 | | 6/2008 |
| WO | WO 2008/000527 | A1 | 12/2008 |
| WO | WO 2009/000527 | | 12/2008 |
| WO | WO 2009/000528 | | 12/2008 |
| WO | WO 2009/000528 | A1 | 12/2008 |
| WO | WO 2009/000529 | | 12/2008 |
| WO | WO 2009/000529 | A2 | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |
| WO | WO 2010/003646 | | 1/2010 |
| WO | WO 2010/028739 | | 3/2010 |
| WO | WO 2011/012281 | | 2/2011 |
| WO | WO 2011/032665 | | 3/2011 |
| WO | WO 2011/032671 | | 3/2011 |

OTHER PUBLICATIONS

German Search Report, German Patent Application No. DE 102007029204, Aug. 21, 2007, 4 pages.
German Search Report, German Patent Application No. DE 102007029203, Aug. 23, 2007, 4 pages.
Hutley M.C. et al., The moiré magnifier, Pure Appl. Opt. 3:133-142, 1994.
Kamal H. et al., Properties of moiré magnifiers, Optical Engineering 37(11):3007-3014, Nov. 1998.
Kipphan H., Handbook of Print Media, Springer, 2001, pp. 206-221.
Lippmann M. G., Epreuves reversibles—Photographies integrales, Comptes Rendues Acad. Sci. Paris 146:446-451, 1908 (in French).
International Search Report, International Application No. PCT/EP2008/005173, Dec. 15, 2008, 3 pages.
International Preliminary Report on Patentability, International Application No. PCT/EP2008/005173, Corrected Version, English Translation, Mar. 22, 2010, 6 pages.
International Search Report, International Application No. PCT/EP2008/005172, Nov. 21, 2008, 2 pages.
International Preliminary Report on Patentability, International Application No. PCT/EP2008/005172, English Translation, Apr. 1, 2010, 5 pages.
International Search Report, International Application No. PCT/EP2008/005174, Feb. 16, 2009, 3 pages.
International Preliminary Report on Patentability, International Application No. PCT/EP2008/005174, English Translation, Mar. 1, 2010, 7 pages.
International Search Report, International Application No. PCT/EP2008/005171, Nov. 21, 2008, 2 pages.
International Preliminary Report on Patentability, International Application No. PCT/EP2008/005171, English Translation, Mar. 29, 2010, 4 pages.
International Search Report, International Application No. PCT/EP2009/004326, Oct. 19, 2009, 3 pages.
International Preliminary Report on Patentability, International Application No. PCT/EP2009/004326, English Translation, Mar. 22, 2011, 5 pages.
International Search Report, International Application No. PCT/EP2009/005987, Jan. 27, 2010, 3 pages.
International Preliminary Report on Patentability, International Application No. PCT/EP2009/005987, English Translation, May 4, 2011, 5 pages.
International Search Report, International Application No. PCT/EP2008/010739, Nov. 11, 2009, 7 pages.
International Preliminary Report on Patentability, International Application No. PCT/EP2008/010739, Apr. 26, 2010, English Translation, 8 pages.
Mine M., How Offset Printing Works, howstuffworks.com/offset-printing4.htm, Nov. 9, 2007, 6 pages.
Rahm, Michael, Modulo mapping—Novel Method to Arrange Microstructures for Moiré Magnifier Type Security Features, Abstract, Session 5: Optically Variable Security I, Jan. 22, 2010, Optical Document Security II, The 2010 Conference on Optical Security and Counterfeit Deterrence, Jan. 20-22, 2010, San Francisco, p. 1-5.
Rauscher W. et al., Novel method to arrange microstructures for moiré magnifier type security features, Optical Document Security II, San Francisco, Jan. 20-22, 2010, pp. 1-11.

* cited by examiner

Figure 7D:
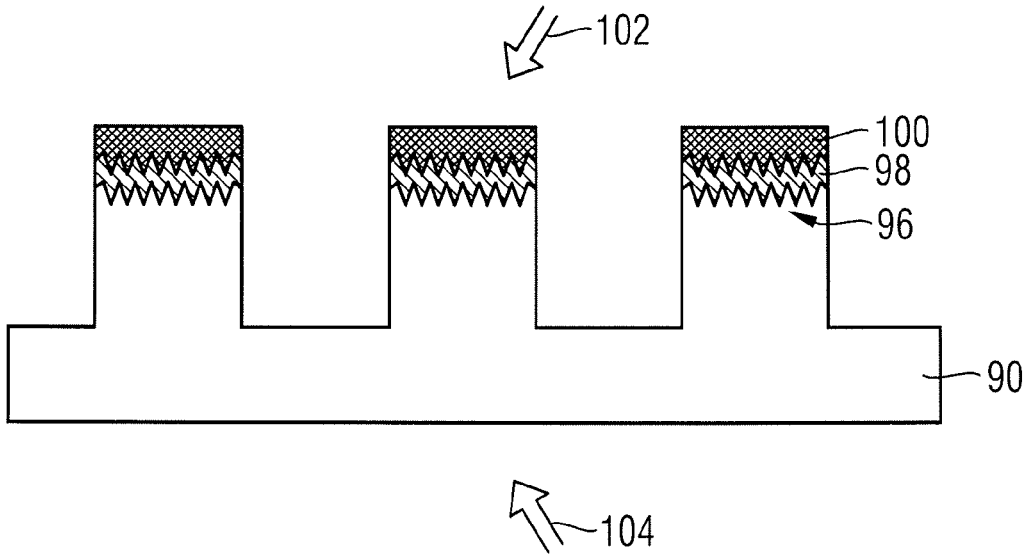

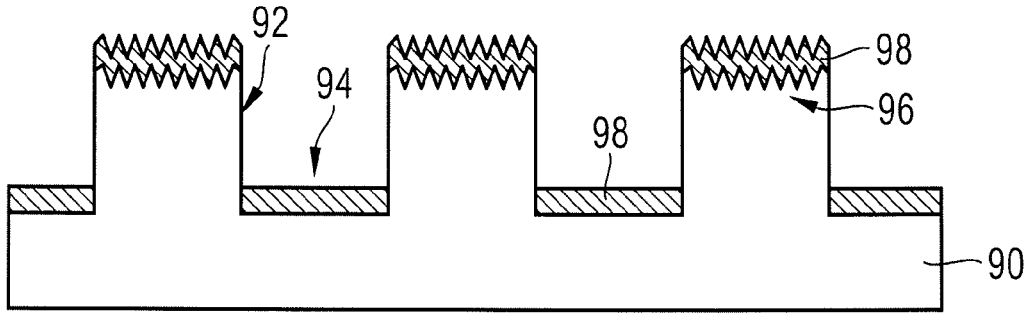
Fig. 7a
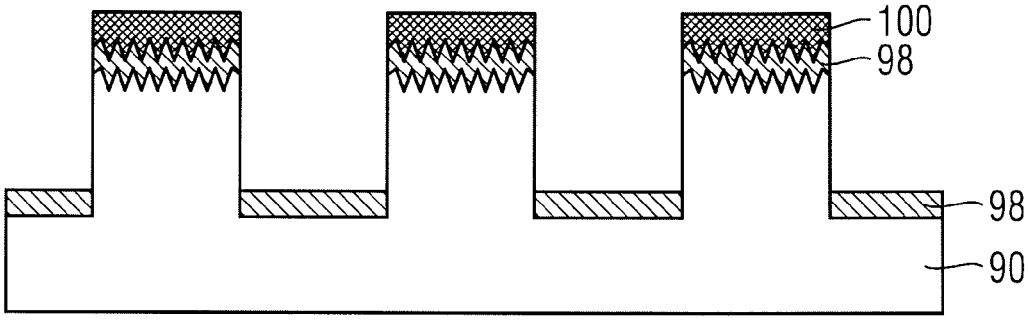
Fig. 7b
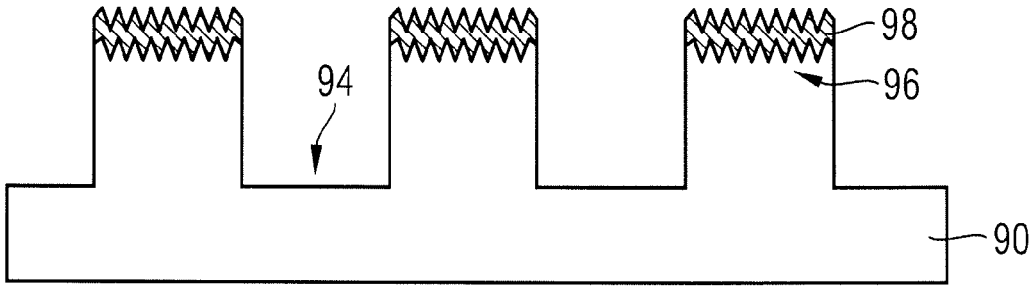

METHOD FOR PRODUCING A MICROSTRUCTURE

CROSS-REFERENCE TO RELATED APPLICATIONS

This application is the U.S. National Stage of International Application No. PCT/EP2008/010739, filed Dec. 17, 2008, which claims the benefit of German Patent Application DE 010 2007 062 089.8, filed Dec. 21, 2007, both of which are hereby incorporated by reference to the extent not inconsistent with the disclosure herewith.

The present invention relates to a method for producing a micropattern on a substrate, an apparatus for executing the method, a thus manufacturable micropattern and an object having such a micropattern.

For protection, data carriers, such as value or identification documents, but also other valuable articles, such as branded articles, are often provided with security elements that permit the authenticity of the data carrier to be verified, and that simultaneously serve as protection against unauthorized reproduction. The security elements can be developed, for example, in the form of a security thread embedded in a banknote, a cover foil for a banknote having a hole, an applied security strip or a self-supporting transfer element that, after its manufacture, is applied to a value document.

Here, security elements having optically variable elements that, at different viewing angles, convey to the viewer a different image impression play a special role, since these cannot be reproduced even with top-quality color copiers. For this, the security elements can be furnished with security features in the form of diffraction-optically effective micro- or nanopatterns, such as with conventional embossed holograms or other hologram-like diffraction patterns, as are described, for example, in publications EP 0 330 733 A1 and EP 0 064 067 A1.

Also so-called moiré magnification arrangements have been in use for some time as security features. The fundamental operating principle of such moiré magnification arrangements is described in the article "The moiré magnifier," M. C. Hutley, R. Hunt, R. F. Stevens and P. Savander, Pure Appl. Opt. 3 (1994), pp. 133-142. In short, moiré magnification accordingly refers to a phenomenon that occurs when a grid comprised of identical image objects is viewed through a lens grid having approximately the same grid dimension. As with every pair of similar grids, a moiré pattern results, each of the moiré strips in this case appearing in the shape of a magnified and rotated image of the repeated elements of the image grid.

Based on that, the object of the present invention is to avoid the disadvantages of the background art and especially to specify, for producing a micropattern on a substrate, an improved method that can be used in the manufacture of micro-optical moiré magnification arrangements.

This object is solved by the method having the features of the main claim. An associated apparatus for executing the method, an object having such a micropattern, and a thus manufacturable micropattern are specified in the coordinated claims. Developments of the present invention are the subject of the dependent claims.

According to the present invention, in a method for producing a micropattern on a substrate,

- a substrate is provided with a relief pattern that exhibits elevations and depressions, and in which the elevations and/or depressions are arranged in the form of the desired micropattern, and
- with a printing tool, an imprint material is transferred to the relief pattern, the viscosity of the imprint material being chosen such that the imprint material is selectively transferred either substantially only onto the elevations or substantially only into the depressions of the relief pattern.

Here, the chosen wording, according to which the imprint material is selectively transferred either substantially only onto the elevations or substantially only into the depressions of the relief pattern, accounts for the fact that, for example, when transferring the imprint material into the depressions, in practice, a light toning film may remain on the elevations of the relief pattern that does not impair the visual impression of the micropattern.

According to a preferred first aspect of the present invention, with the printing tool, a high-viscosity imprint material is selectively transferred substantially only onto the elevations of the relief pattern. Here, the high-viscosity imprint material is advantageously transferred in a layer thickness that is smaller than the pattern depth of the relief patterns. Here, the pattern depth determines the height difference between elevations and depressions in the relief pattern. The transferred layer thickness of the imprint material is preferably less than 50%, particularly preferably less than 30% and very particularly preferably even less than 15% of the pattern depth of the relief patterns.

Advantageously, the desired size and/or depth of the transfer regions in which the imprint material is to be transferred onto the elevations of the relief pattern is specified. The hardness and the surface roughness of the printing tool and the pressure when transferring the imprint material are then chosen in accordance with the desired size and/or depth of the transfer regions. The pressure when transferring the imprint material is expediently chosen to be so low that the imprint material is not crushed. The imprint material can also be transferred to the relief pattern substantially without pressure, a predetermined spacing between the printing unit and the relief pattern being filled by the imprint material.

The imprint material is particularly advantageously transferred in the offset printing process or in the flexographic printing process. Here, to obtain the best possible results, it may be necessary to modify the standard offset printing process. For example, instead of a (rubber) printing blanket, a rubber roller can be used, especially to facilitate a continuous and seamless as well as more homogeneous and precise printing on raised patterns. Instead of a (rubber) printing blanket, in principle, also a metal roller can be provided, with a rubber roller then being appropriate as the impression cylinder. Instead of a printing plate, also the use of a cylinder that is coated directly with a polymer may be considered in order to print continuously and seamlessly. In further modifications, the impression cylinder can be dispensed with. Instead, the rubber blanket or rubber roller, or the ink transfer cylinder in general, is directly colored contiguously or having a motif, similar to a relief printing process. The curing can occur under inert gas in order to be able to cure also extremely thin films well.

The printed-on, raised sites can be provided with protective lacquer in order to prevent a resoftening in the following process.

As the imprint material, especially a material having a viscosity between about 10 mPa*s and about 200 Pa*s, preferably between about 800 mPa*s and about 150 Pa*s at room temperature is chosen. Here, also a potentially existing structural viscosity of the imprint material may have to be taken into account. As imprint materials, especially a printing ink, preferably an offset-printing ink, a radiation-curing, heat-curing or oxidatively drying printing ink, an adhesive, such as a high-viscosity heat seal coating, and/or a water-activatable adhesive system may be considered. All imprint materials can be effect-pigments and especially include luminescent pigments, thermochromic pigments, metal pigments and/or pearlescent pigments.

Particularly preferably used are imprint materials that exhibit a certain stickiness, i.e. that are not tack free. In the context of the present description, the term "not tack free" also means sticky in the sense of a sticky surface. The check can be done through the following test: Coated foil pieces of about 100 $cm^2$ are stacked and loaded with a weight of 10 kg and stored for 72 hours at 40° C. If, afterwards, the foil pieces can be separated from one another only with damage to the coatings, the coating is to be considered not tack free.

If an adhesive is transferred as the imprint material, then, after the adhesive is transferred, the relief pattern can be brought into contact with a transfer medium, and a transfer material transferred from the transfer medium to the relief pattern elevations provided with adhesive. The transfer medium can be, for example, a coated foil, a hot embossing foil or a transfer roller. As the transfer materials, especially inks, colored foils, effect coatings, effect pigments, colored, black or white pigments, dyes, effect layers or metalizations may be considered. Also sub-regions of a release-capable hologram or of another hologram-like diffraction pattern can be chosen as the transfer material and transferred to the adhesive-coated elevations, as described in greater detail below. The potentially still sticky adhesive layer having the transfer material can be cured in a further step.

After the adhesive is transferred, the relief pattern can also be dusted directly with a transfer material, a potential excess of the transfer material being able to be removed following the dusting, preferably by a non-contact method. In addition, particularly blowing off, sweeping off, brushing off, removal with the aid of an electrostatic method, or a combination of two or more of these methods may be considered. Here, the transfer material can also be optimized for removal with an electrostatic method. The unit that contactlessly takes up the excess can itself be mechanically cleaned. The excess can at least partially be fed back into the process. The removal of the excess can also occur only after the curing of the high-viscosity adhesive layer. Direct dusting is appropriate especially for metal pigments, for example for bronzing the embossing coating layer.

In an advantageous development of the method, after the adhesive is transferred, a laminating foil is laminated onto the relief pattern. Here, on the one hand, the laminating foil serves to protect the micropattern, and on the other hand, it permits the laminating foil surface opposite the micropatterns to be provided with an adhesive layer that facilitates a highly adhesive embedding of the layer sequence composed of substrate, micropattern and laminating foil in a security paper, value document or the like.

Through the transfer of the adhesive only onto the elevations of the relief pattern, a plurality of air-filled microcavities is created in the region between the laminating foil and the relief pattern. These microcavities have the refractive index of the air they contain (n=1) and thus exhibit a large refractive index difference to the relief pattern material (n≈1.5). In this way, a desired refractive or optically variable effect of the relief patterns is obtained despite foil lamination, as explained in greater detail below with reference to some exemplary embodiments.

According to a further embodiment according to the present invention, a transfer material provided with an adhesive is transferred onto the elevations of the relief pattern as the imprint material. Here, especially an ink, a colored foil, an effect coating, effect pigments, colored pigments, black pigments, white pigments, dyes, effect layers, a metalization, a sub-region of a hologram or of a hologram-like diffraction pattern or also a color-shifting element, especially a color-shifting thin-film element or an element including at least one liquid crystal layer can be chosen as the transfer material.

In visually particularly attractive variants, the micropattern constitutes the motif image of a microoptical magnification arrangement that, after the application of a viewing grid to the front of a security element, produces a specified target image. Through the transfer material, the microoptical magnification arrangement is additionally provided with a reverse-side effect, for example a reverse-side hologram or a reverse-side color-shift effect, as explained in greater detail below.

In a development of the present invention, different high-viscosity imprint materials can be transferred, especially imprint materials of different colors or provided with different effect pigments.

Some of the elevations of embossed relief patterns exhibit a mild drop in height toward the edges. To avoid possible irregularities when printing, before the desired imprint material is transferred, a high-viscosity lacquer layer can be transferred that evens out the sloping edges of the elevations.

To support the method, the elevations and/or depressions of the relief pattern can also be rounded, or provided with continuous transitions and/or with additional patterns. For example, the elevations can be developed having a sharply delimited, high-standing edge region to more strongly limit the transferred imprint material to the region of the elevations. Such edge elevations are typically on the order of magnitude of 1 μm. Through this measure, the requirements for the viscosity of the imprint material can be reduced, if appropriate.

The elevations of the relief pattern can also be provided with a microrelief pattern, especially with a diffractive microrelief pattern for producing a hologram or a hologram-like diffraction pattern. Alternatively, the elevations can also be provided with an achromatic microrelief pattern, that is, one that does not appear to be colored. The elevations of the relief pattern can also exhibit a further super-pattern, such as spikes that keep the imprint material on the elevations better. Such a measure is appropriate especially for narrow lines in order to prevent crushing of the imprint material.

Also a high-viscosity resist coating, especially a colored high-viscosity resist coating, can be chosen as the imprint material. The use of such a resist coating is appropriate especially in interplay with metalizations of the relief pattern, since then the non-raised regions can be systematically demetalized.

For the advantageous production of a micropattern having two microrelief patterns that are visible from opposing sides and having a common, perfectly registered negative pattern, the relief pattern provided with a microrelief pattern in the elevations is contiguously metalized, and a high-viscosity resist coating is selectively transferred onto the elevations of the metalized relief pattern. After the transfer, the relief pattern is demetalized in regions that are not protected by resist coating, the relief pattern provided with an embossing coating layer after the demetalization step, and a further microrelief pattern, especially a diffractive microrelief pattern, is embossed in the embossing coating layer.

Thereafter, the relief pattern is metalized anew, a high-viscosity resist coating is selectively transferred onto the elevations of the relief pattern anew, the relief pattern that was metalized anew is demetalized anew in regions that are not protected by resist coating and, if applicable, the resist coating removed. If desired, a further high-viscosity printing ink can thereafter be transferred onto the elevations, so that, from the top, the microrelief patterns appear colored.

A demetalization step can be saved in that a high-viscosity resist coating is selectively transferred onto the elevations of the contiguously metalized relief pattern, and this resist coating is provided with the further microrelief pattern embossing. For this purpose, a thermoplastic resist coating, for example, can be used. Then the relief pattern is metalized again and a high-viscosity resist coating is again selectively transferred onto the elevations of the relief pattern. The again metalized relief pattern is then demetalized in regions that are not protected by resist coating, which removes both the first and the second metalization.

If larger continuous demetalization areas are provided, a soluble washable ink is preferably imprinted on the relief pattern in the form of the desired demetalization regions before the metalization, and after the metalization, the washable ink washed off together therewith by a solvent. Further details on such a washing process can be found in publication WO 99/13157, whose disclosure is incorporated herein by reference.

In addition, spacing marks for setting a defined spacing and/or pressure when transferring the imprint material can be applied both during and after the embossing. The thickness of additional spacing marks composed of clear lacquer, which need not occur in the end product, can be chosen arbitrarily within broad limits. Depending on the available printing machine, strips of a defined thickness can facilitate setting a defined spacing and/or pressure that prevails between the printing blanket and the foil. When at least partially taken into account when embossing, such spacing marks can form uniformly low-lying and uniformly high-lying regions lying next to each other.

Such regions without further patterning can also advantageously be used as indicator marks and be measured and registered. In this way, the inking and/or the printing, for example, can be controlled according to a specified, maximum permissible toning film in the low-lying regions, or the color saturation in the high-lying regions of the indicator marks.

The imprint material can also be provided with particles of a defined size that prevent a crushing of the imprint material when transferring, and in this way likewise function as a kind of spacer.

In general, the use of relatively hard printing blankets in the method of the first aspect of the present invention advantageous, since it is more difficult for a hard printing blanket to reach lower-lying sites of the relief pattern. Softer printing blankets, in contrast, facilitate a more even, lower pressure and they can help to compensate for imperfections in the overall system. Depending on the available equipment and the desired results, a suitable compromise must thus be found for the hardness of the printing blanket.

In general, the application of the high-viscosity imprint material can also occur in multiple layers and/or in the form of a motif. Also a high-viscosity clear lacquer can be transferred as the uppermost layer. If a toning is unavoidable for a motif, for example due to too minor height differences or too large uncovered areas, then, if the desired view is from above, that is, from the direction of the raised patterns, the problem can be circumvented by subsequent printing of a low-viscosity lithopone formulation. In this way, the existing toning film in the valleys is covered in white, as explained in detail below in connection with the second aspect of the present invention. For reverse viewing, the lithopone formulation can also be printed first, and thereafter the high-viscosity printing ink.

If a relatively low-viscosity imprint material is to be transferred onto the elevations of the relief pattern, then a pronounced structural viscosity of the imprint material is advantageous.

Structural viscosity of a liquid or of the imprint material within the meaning of the present invention is the property of displaying a lower viscosity at high shear forces. Thus, the stronger the shear is that acts on the imprint material, the less viscous, that is, thinner, it is. Since the viscosity does not remain constant, this is classified as non-Newtonian behavior. Here, the decrease in the viscosity is created by a structural change in the imprint material that ensures that the individual particles of the imprint material (e.g. polymer chains) can glide past one another better.

For example, printing inks are transformed by mechanical action, such as stirring, shaking, spreading or blade coating, from a firm or paste-like consistency to a flowing consistency. In offset printing, this occurs through the ink splittings in the inking unit, intensified by oscillating distributor rollers.

If the viscosity does not increase again immediately after the shear force is reduced, this behavior is referred to as thixotropy. However, an immediate increase in the viscosity after the application of the imprint material is preferred, i.e. the imprint material should immediately stand or not run.

According to a likewise advantageous second aspect of the present invention, with the printing tool, an imprint material, especially a low-viscosity imprint material is selectively transferred substantially only into the depressions of the relief pattern. Here, in selecting the low-viscosity imprint material, the surface tension of the imprint material is preferably also coordinated with the surface energy of the relief pattern.

In this aspect, especially an imprint material having a viscosity between about 3 mPa*s and about 1500 mPa*s at room temperature is chosen as the imprint material. Printing inks, especially dye solutions, pigment dispersions, inks or also preferably low-viscosity liquid crystal solutions may be considered as the imprint materials. In the latter case, the depressions of the relief pattern can also be developed having alignment patterns for aligning liquid crystals. The dye solutions or pigment dispersions can optionally contain binders.

The transfer of the imprint material can also occur in two steps, a low-viscosity printing ink or liquid crystal solution having a low binder content that selectively flows into the depressions of the relief pattern being transferred first. Then a solution having a high binder content is transferred that fixes the printing ink or liquid crystal solution in the depressions of the relief pattern.

In further variants of the present invention, also a low-viscosity adhesive or a low-viscosity resist coating can be chosen as the imprint material. All imprint materials can be effect-pigmented, especially luminescent pigments, thermochromic pigments, metal pigments and/or pearlescent pigments being able to be included.

Also in this aspect of the present invention, different low-viscosity imprint materials can advantageously be transferred into the depressions, especially imprint materials of different colors or provided with different effect pigments.

The elevations of embossed relief patterns are often surrounded by deep sites at their edge regions. If only a small amount of an imprint material is transferred, then the imprint material initially accumulates in the region of these edges. If this effect is desired for design reasons, for example to provide the elevation pattern with a circumferential colored edge, then the imprint material can be transferred in such a small amount that, when transferring, it flows only into the depression edge regions that immediately surround the elevations.

If, in contrast, the depressions are to be filled out evenly, it can be expedient, before the desired imprint material is transferred, to transfer a small amount of a low-viscosity clear lacquer that fills up the edge regions of the depressions that immediately surround the elevations. In the subsequent transfer, the imprint material then flows evenly into the depressions.

To support the method, the elevations and/or depressions of the relief pattern can also be rounded, or provided with continuous transitions and/or with additional patterns. In particular, the depressions can be developed having rounded transitions to the elevations in order to avoid the above-described effect of a filling up of the depressions beginning from the edge regions.

In other embodiments, the elevations can also be provided with a lotus pattern to produce lightly crosslinkable elevation surfaces. Such lotus patterns reduce the contact area between the elevations and the imprint material to be transferred, such that said imprint material practically cannot adhere to the surface of the elevations and flows yet more lightly into the depressions. The depressions of the relief pattern can also be provided with a microrelief pattern, for example a diffractive or achromatic microrelief pattern.

Both of the cited aspects of the present invention can, of course, also be combined with one another. Thus, for example, in a first step, a first high-viscosity imprint material can be selectively transferred substantially only onto the elevations of the relief pattern, and in a second step, a second low-viscosity imprint material selectively transferred substantially only into the depressions of the relief pattern. In a suitable method, the low-viscosity imprint material can also be selectively transferred into the depressions first, and then the high-viscosity imprint material selectively transferred onto the elevations of the relief pattern.

Due to the elevations and depressions of the micropattern, preferably micropattern elements having a line width between about 1 μm and about 10 μm and/or having a pattern depth between about 0.5 μm and about 20 μm, preferably between about 1 μm and about 10 μm, are formed.

The method according to the present invention can particularly advantageously be used in the manufacture of micro-optical moiré magnification arrangements, as are described in publications DE 10 2005 062 132 A1 and WO 2007/076952 A2, in the manufacture of moiré-type micro-optical magnification arrangements, as are described in applications DE 10 2007 029 203.3 and PCT/EP2008/005173, and in the manufacture of modulo magnification arrangements, as are described especially in applications PCT/EP2008/005171 and PCT/EP2008/005172. All these micro-optical magnification arrangements include a motif image having micropatterns that, when viewed with a suitably coordinated viewing grid, reconstructs a specified target image. As explained in greater detail in the above-mentioned publications and applications, here, it is possible to produce a number of visually attractive magnification and movement effects that lead to a high recognition value and a high counterfeit security of the security elements furnished therewith. However, it should be emphasized that the present invention is not limited to these applications. Rather, the described method can advantageously also be used in the manufacture of other security elements, for example in the production of microtext prints on paper or foil.

In an advantageous development of the present invention, the micropattern forms a motif image that is subdivided into a plurality of cells, in each of which are arranged depicted regions of a specified target image. The lateral dimensions of the depicted regions are preferably between about 5 μm and about 50 μm, especially between about 10 μm and about 35 μm. In the first micro-optical moiré magnification arrangements mentioned above, the depicted regions of the cells of the motif image each constitute scaled-down images of the specified target image that fit completely within a cell. In the moiré-type micro-optical magnification arrangements, the depicted regions of multiple spaced-apart cells of the motif image constitute in each case, taken together, a scaled-down and, if applicable, linearly depicted likeness of the target image, whose dimension is larger than one cell of the motif image. In the most general case, the magnification arrangement constitutes a modulo magnification arrangement in which the depicted regions of the cells of the motif image each constitute incomplete sections of the specified target image that are mapped by a modulo operation.

The security element preferably further exhibits a viewing grid composed of a plurality of viewing grid elements for reconstructing the specified target image when the motif image is viewed with the aid of the viewing grid. Here, the lateral dimensions of the viewing grid elements are advantageously between about 5 μm and about 50 μm, especially between about 10 μm and about 35 μm.

In the special case of a micro-optical moiré magnification arrangement, a motif image composed of a planar periodic or at least locally periodic arrangement of a plurality of micromotif elements is preferably applied as the micropattern. Here, the lateral dimensions of the micromotif elements are advantageously between about 3 μm and about 50 μm, preferably between about 10 μm and about 35 μm. In addition, the opposing side of the substrate is expediently provided with a planar periodic or at least locally periodic arrangement of a plurality of microfocusing elements for the moiré-magnified viewing of the micromotif elements of the motif image. In some embodiments, it is appropriate to arrange the microfocusing elements and the micromotif elements on the same side of the substrate. Also two-sided embodiments in which a micromotif element arrangement can be viewed through two opposing microfocusing element arrangements may be considered and are explained in the present description in greater detail below.

In moiré magnification arrangements, also in the case of incomplete and irregular coloring of the elevations, regular patterns can be visible when viewed through the lens array, since, according to the functional principle explained above, many individual patterns—here the elevations and depressions of the relief pattern—are averaged to the visible pattern. It is thus also possible to provide, as elevations, fragmentary, raised patterns that are superimposed and form the desired motif only when viewed through the microlenses. However, through the admixture of colorless regions, the achievable maximum contrast is then somewhat reduced.

This principle can also be used to form micropattern elements colored in different intensities. If, for example, a first image component having more intense colors is to appear as a second image component, then the relief pattern can be developed such that, for example, each elevation bears the first image component, but only every second elevation bears the second image component. When viewed, the second image component then appears having a lower color saturation than the first image component. In the same way, through different colorings of the same image component, it is possible to produce mixed colors for the viewer.

In addition to the elements already mentioned, the substrate having the applied micropattern can also be furnished with one or more functional layers for use as a security element for security papers, value documents and the like, with especially layers having visually and/or machine-perceptible security features, protective or coating layers, adhesive layers, heat seal features and the like being able to be used.

To protect against counterfeiting attacks and/or to facilitate further processing, the micropattern applied to the substrate is advantageously provided with a transparent overcoating.

The relief pattern of the substrate can be formed, for example, by a patterned, itself non-adhesive resist coating whose, after patterning, high- and low-lying regions form the elevations and depressions of the relief pattern. Due to the achievable high resolution, the relief pattern is particularly advantageously formed by an embossing pattern having elevations and depressions.

The relief patterns of the substrate are preferably manufactured by embossing in thermoplastic and/or in radiation-curing lacquers.

The present invention also includes an apparatus for executing the described method with a printing tool, for transferring an imprint material selectively either only onto the elevations or only into the depressions of the relief pattern, as well as an object, especially a data carrier or a security element, having a micropattern produced in the described manner. Here, the micropattern is preferably formed by micropattern elements having a line width between about 1 μm and about 10 μm and/or having a pattern depth between about 0.5 μm and about 20 μm, preferably between about 1 μm and about 10 μm. Here, the micropatterns can, of course, also include areal regions and can exhibit both positive elements and negative elements. The elevations and depressions can also form, at least partially, a continuous network.

The substrate of the micropattern can especially comprise a transparent plastic foil or also a paper layer. Advantageously, the substrate exhibits a thickness between about 3 μm and about 50 μm, preferably between about 5 μm and about 25 μm.

According to a particularly preferred development, the object includes a micro-optical moiré magnification arrangement of the kind already described and having the dimensions already specified.

In a preferred embodiment, the object constitutes a security element, especially a security thread, a label or a transfer element for application to a data carrier. For this, the security element can, for example, be furnished to be capable of heat sealing. The total thickness of the security element is expediently between about 20 μm and about 60 μm, preferably between about 30 μm and about 50 μm.

It is likewise preferred when the object is a data carrier, especially a banknote, a value document, a passport, an identification card or a certificate.

Furthermore, the object having the applied micropattern can be furnished with one or more functional layers, especially with layers having visually and/or machine-perceptible security features. Here, contiguous or non-contiguous reflecting, high-index or color-shifting layers, for example, may be used, or also polarizing or phase-shifting layers, opaque or transparent conductive layers, magnetically soft or hard layers, or fluorescent or phosphorescent layers.

The present invention further comprises a micropattern that is manufacturable in the manner described and that comprises a relief pattern having elevations and depressions whose shape and arrangement form the pattern elements of the micropattern, and for which, with a printing tool, an imprint material is selectively transferred either only onto the elevations or only into the depressions of the relief pattern.

The present invention further comprises a method for producing a high-resolution printing layer on a target substrate, in which, with a method of the kind described above, a micropattern is first produced in which the imprint material is selectively transferred substantially only onto the elevations of the relief pattern. The micropattern thus produced is then brought into contact with the desired target substrate and the imprint material that is present on the elevations of the relief pattern is transferred to the target substrate.

Further exemplary embodiments and advantages of the present invention are described below with reference to the drawings. To improve clarity, a depiction to scale and proportion was dispensed with in the drawings.

Figure 2A:
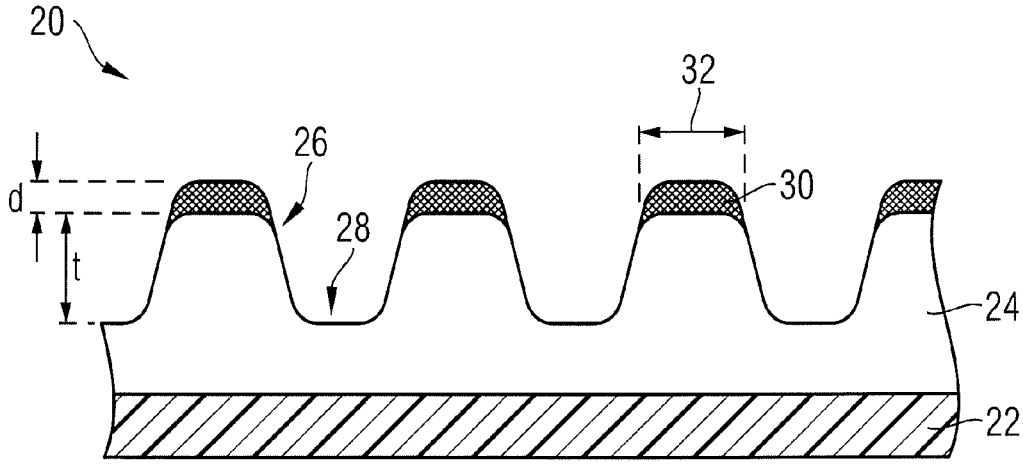
Figure 2B:
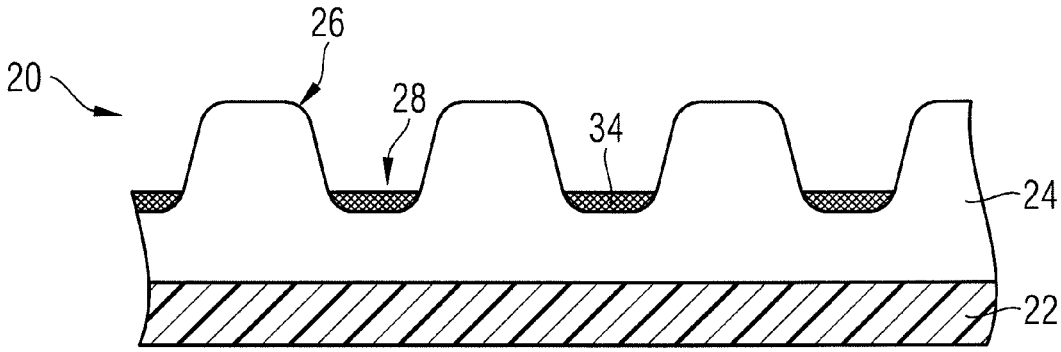
Figure 3:
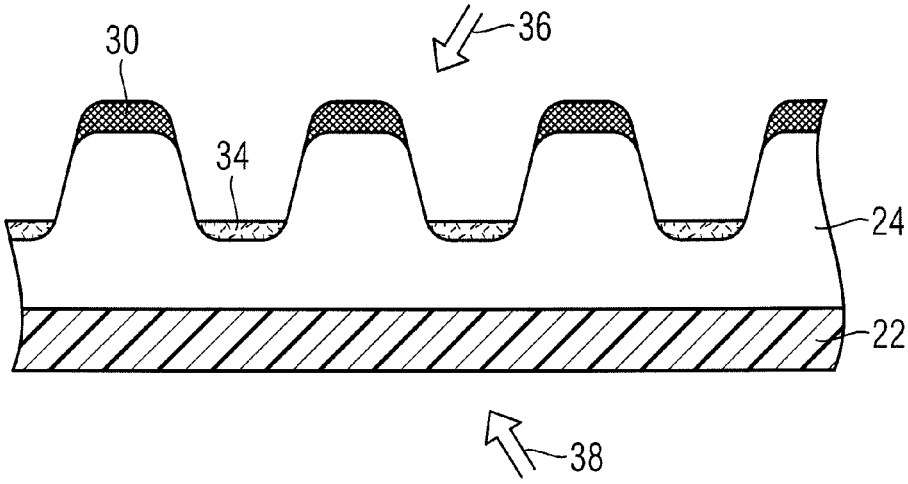
Figure 4:
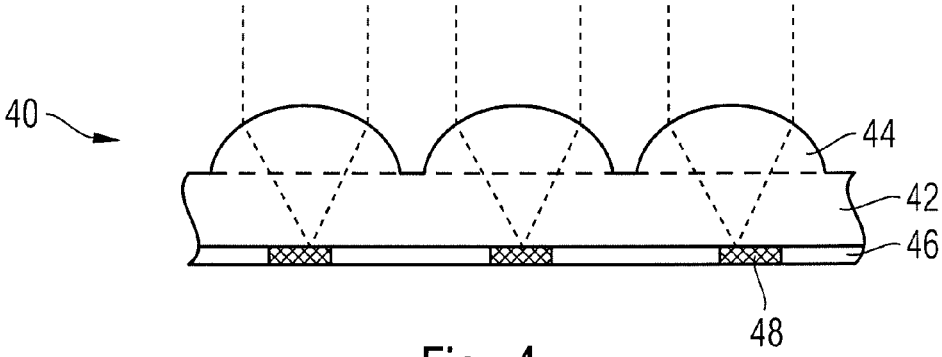
Figure 5:
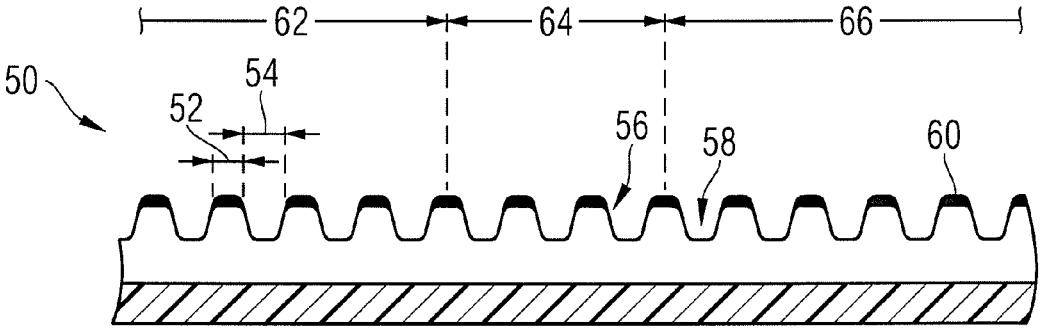
Figure 6A:
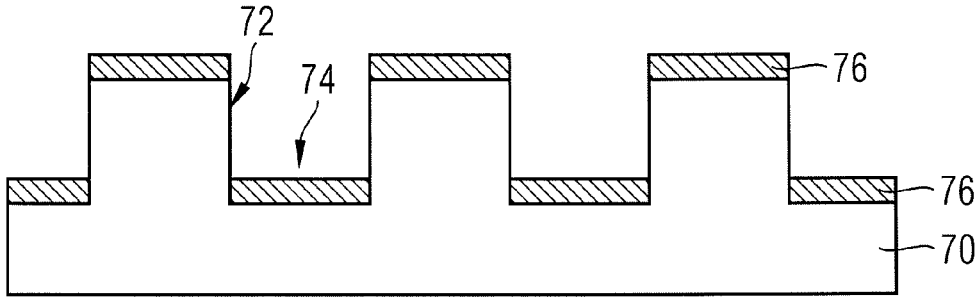
Figure 6B:
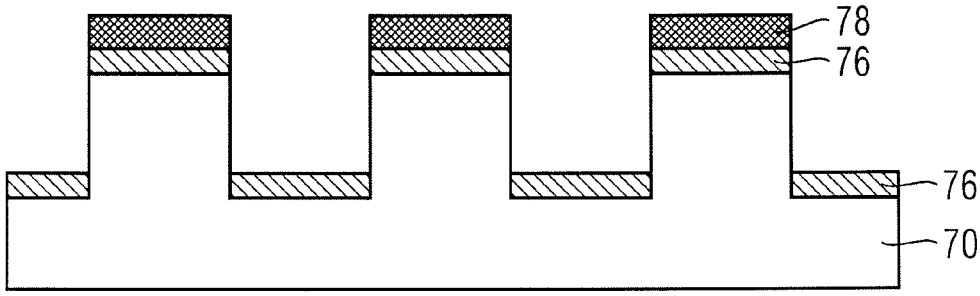
Figure 6C:
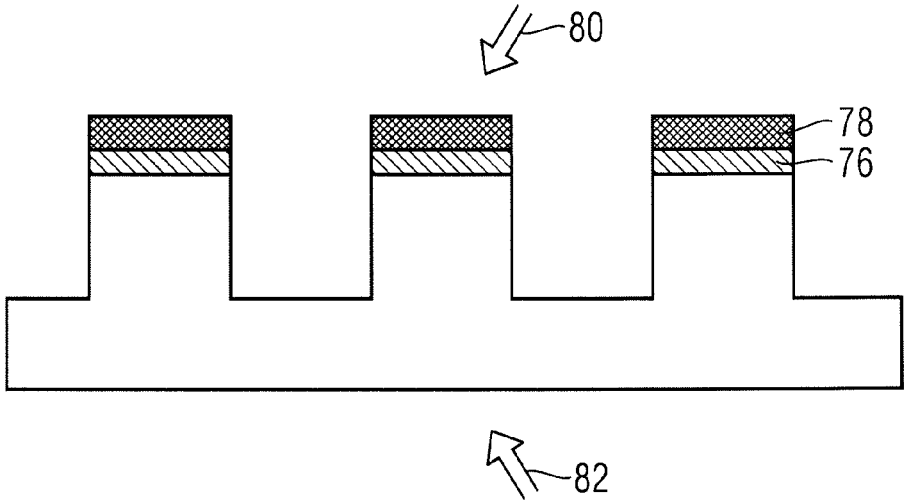
Figure 8:
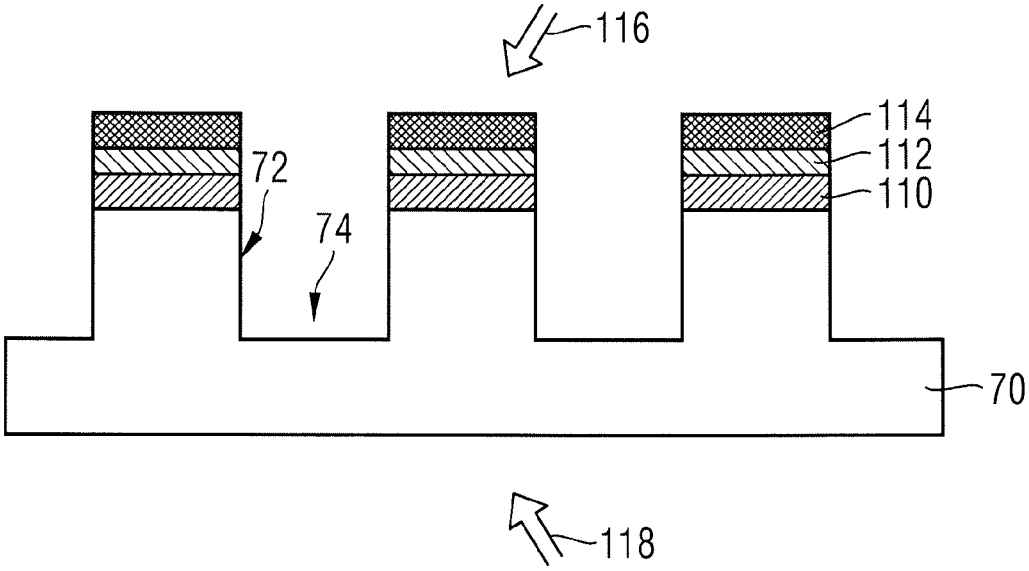
Figure 9A:
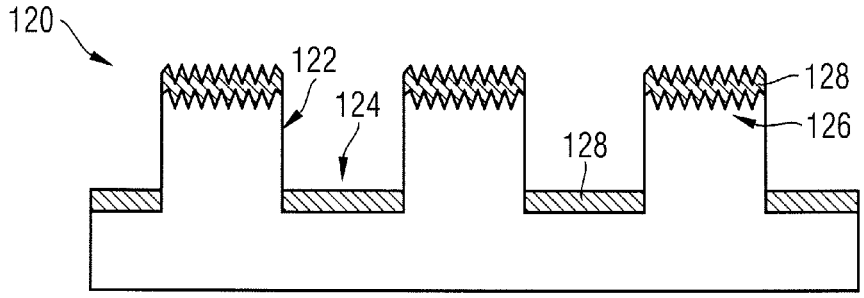
Figure 9B:
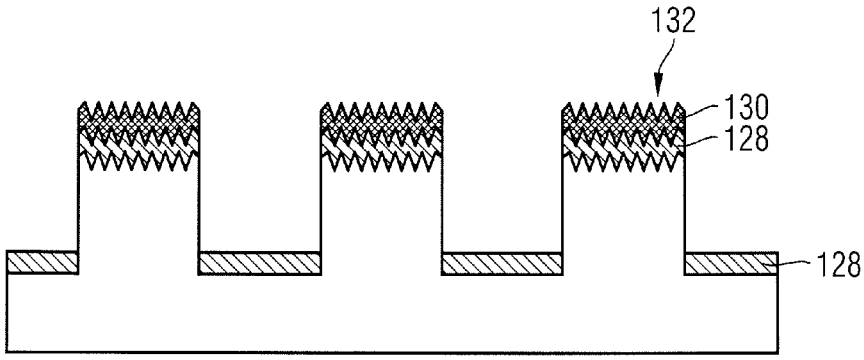
Figure 9C:
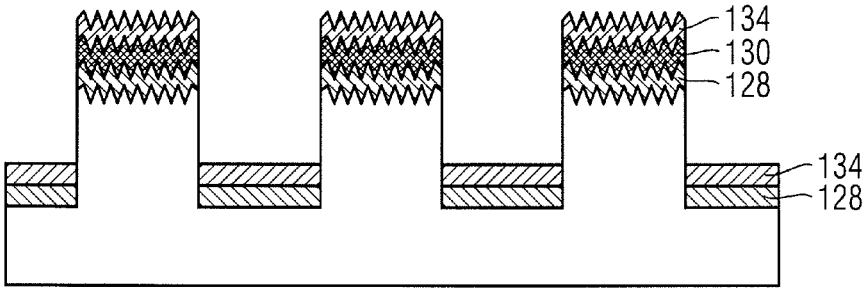
Figure 9D:
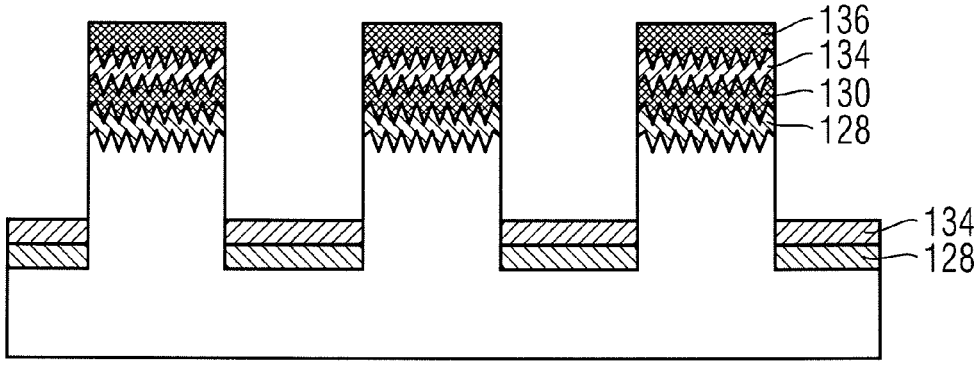
Figure 9E:
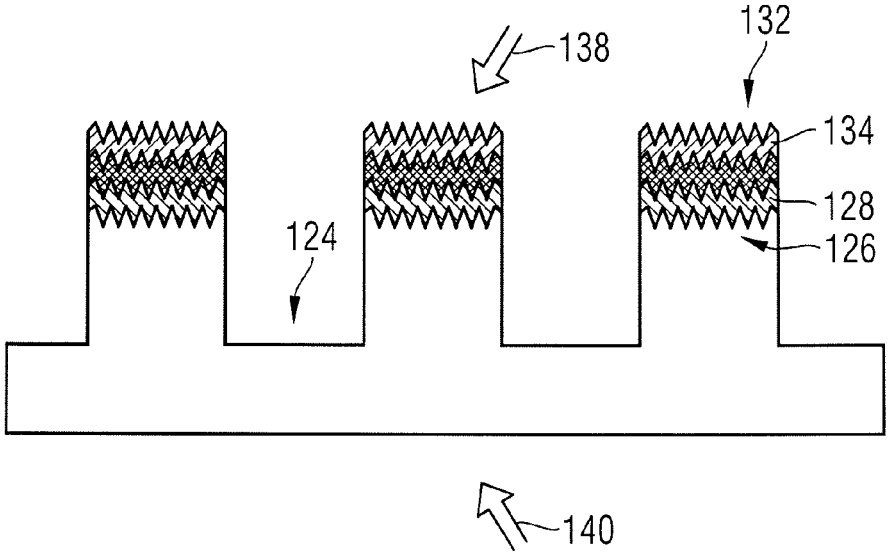
Figure 10:
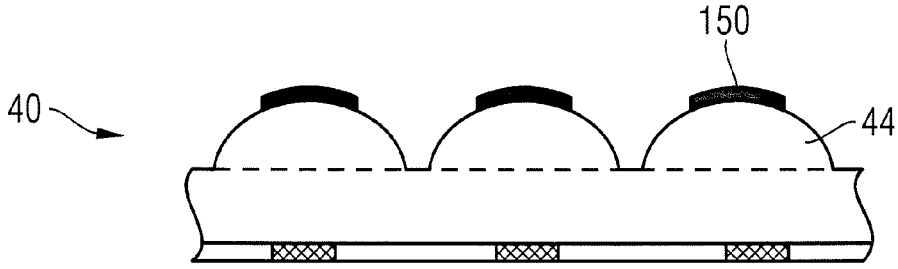
Figure 11:
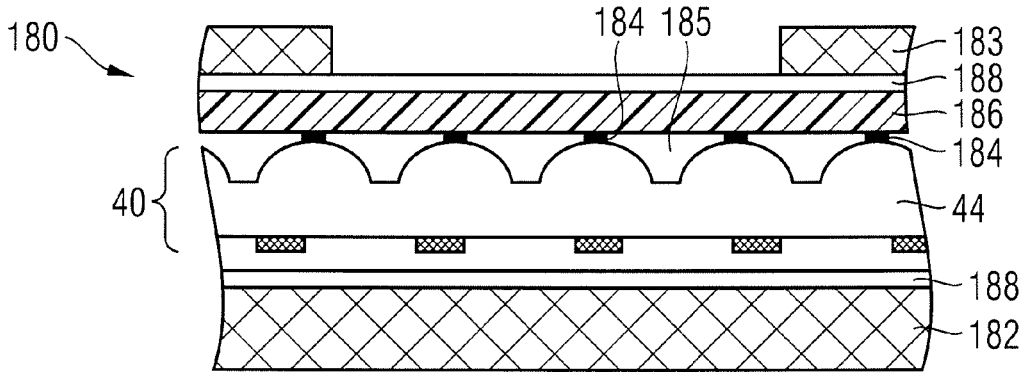
Figure 12:
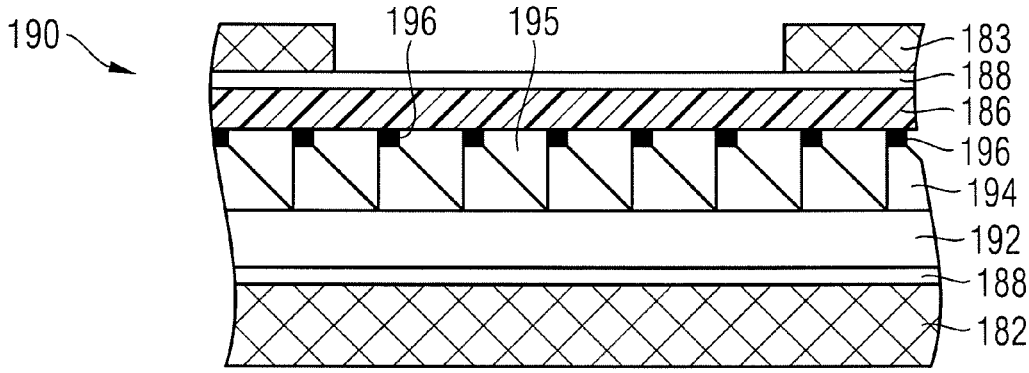
Figure 13:
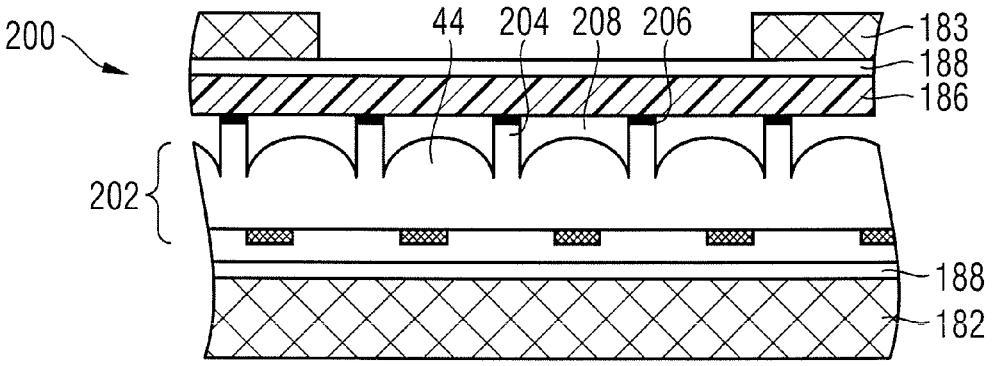
Figure 14A:
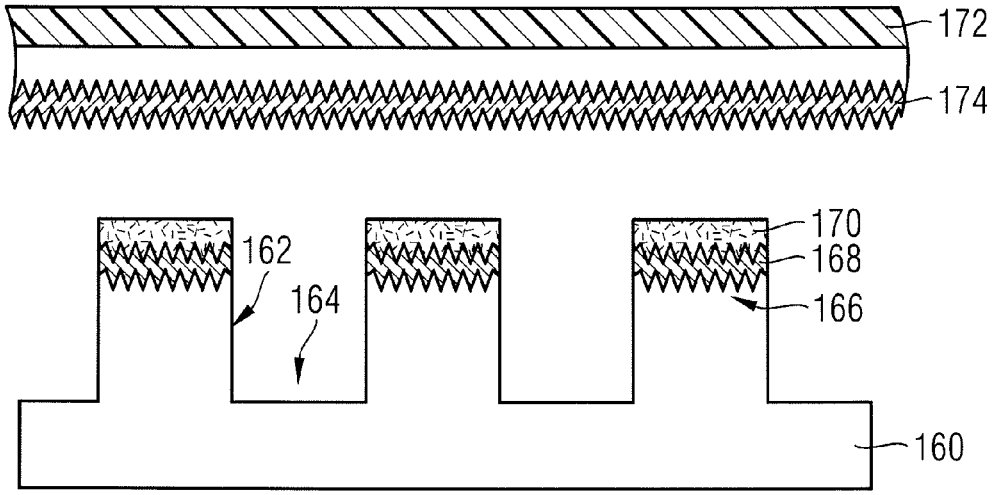
Figure 14B:
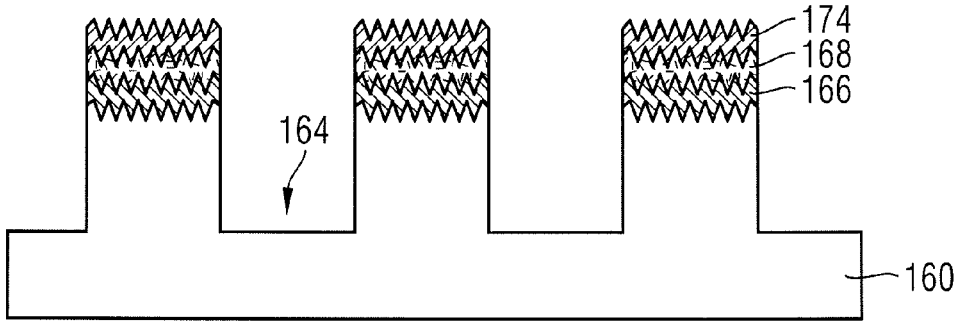
Figure 15A:
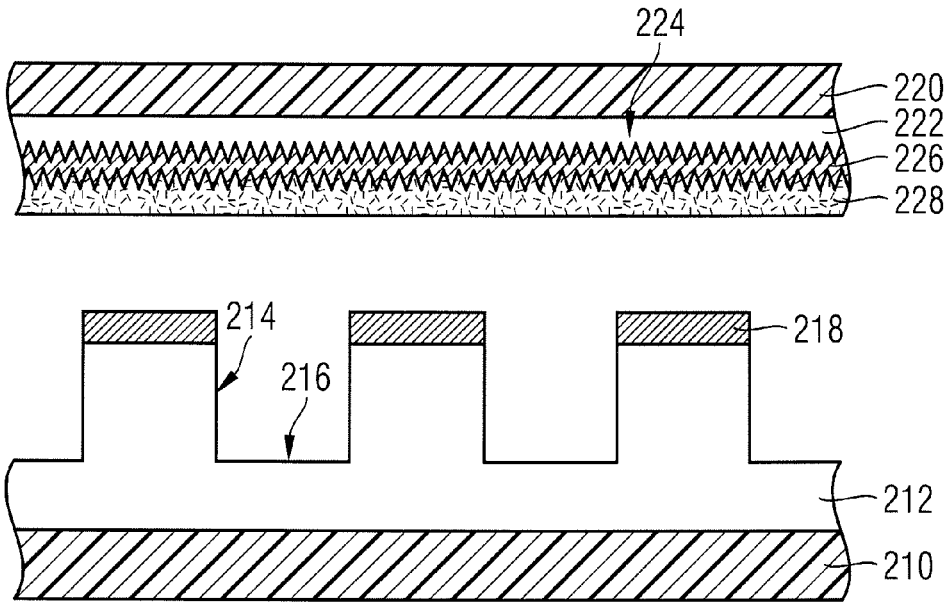
Figure 15B:
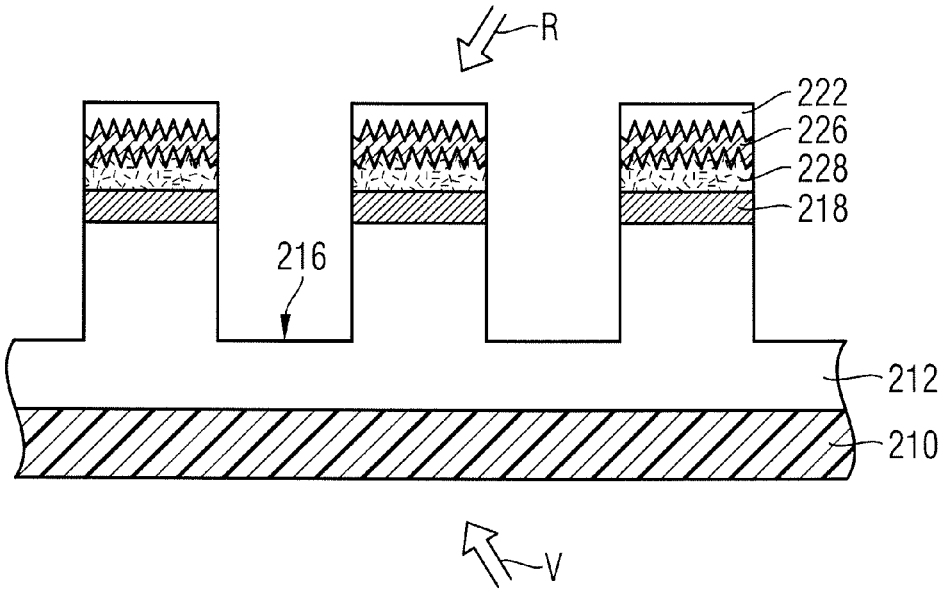
Figure 16A:
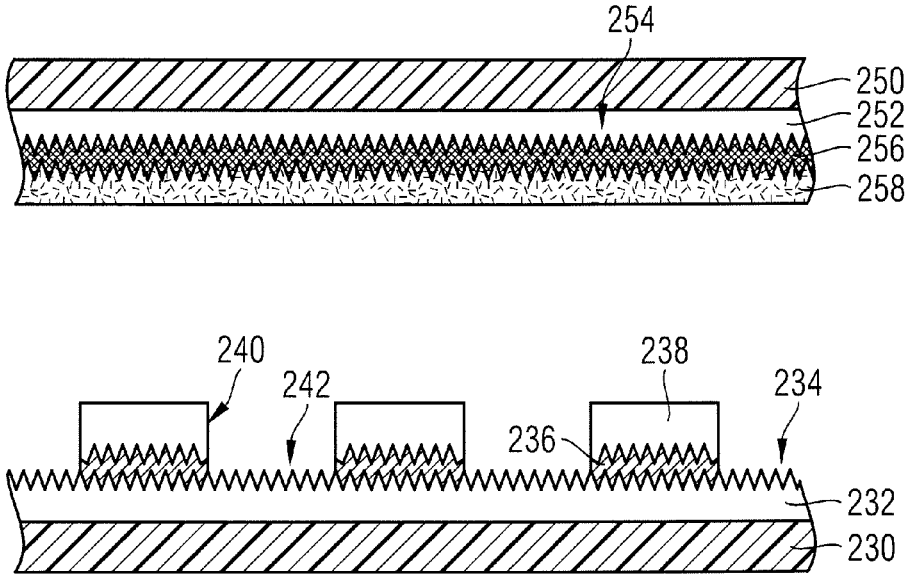
Figure 16B:
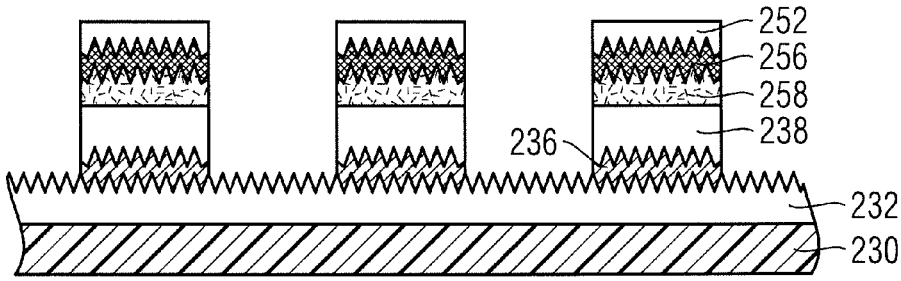
Figure 17A:
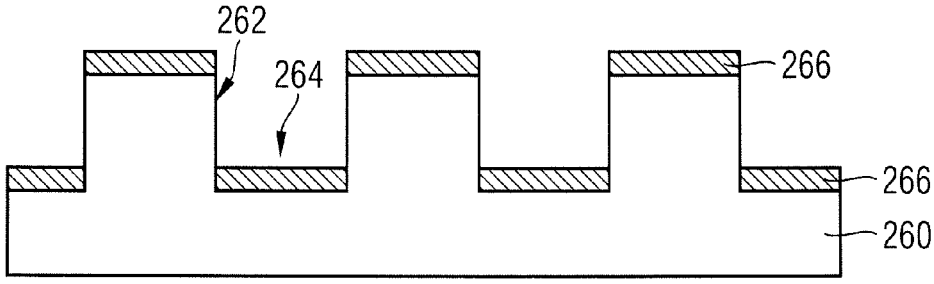
Figure 17B:
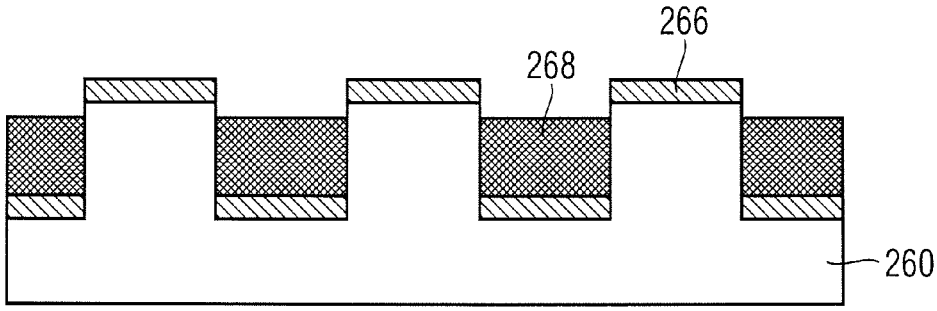
Figure 17C:
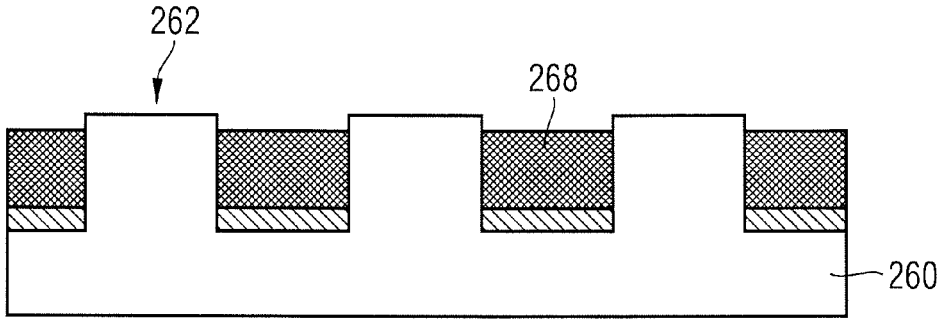
Figure 18A:
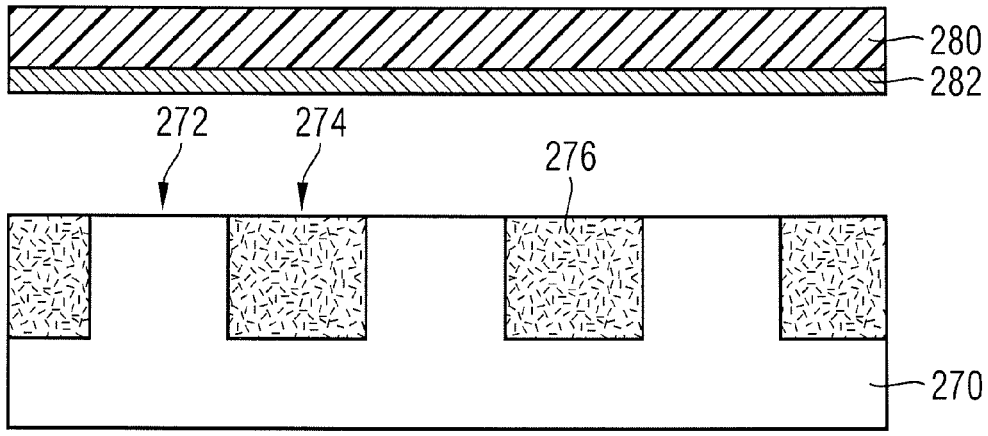
Figure 18B:
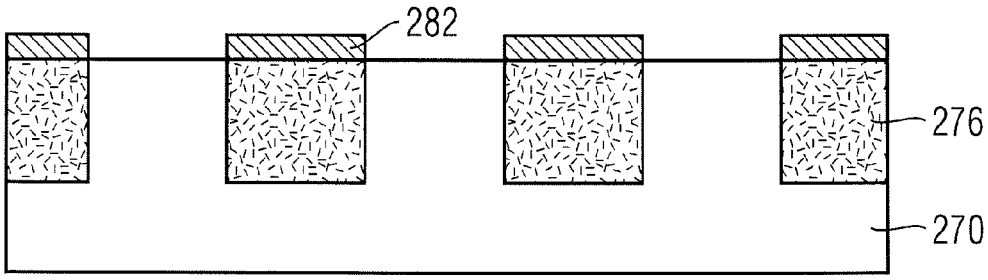
Figure 18C:
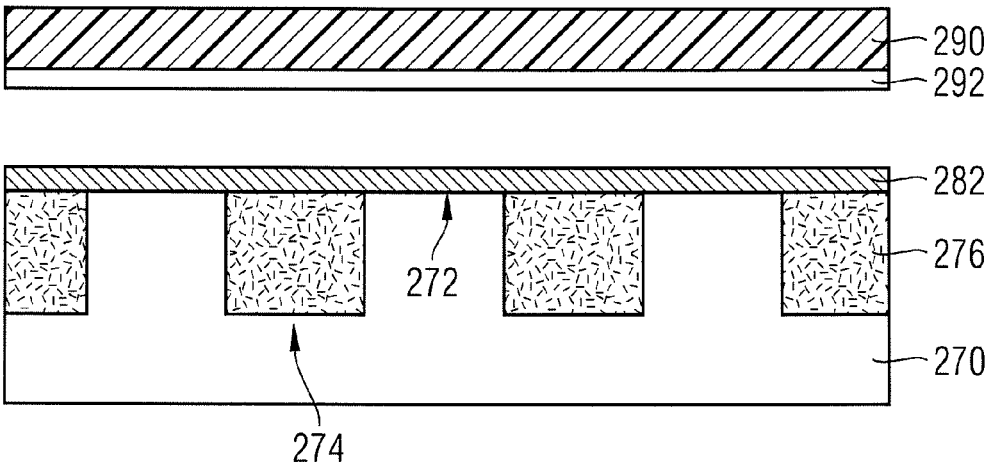
Figure 19A:
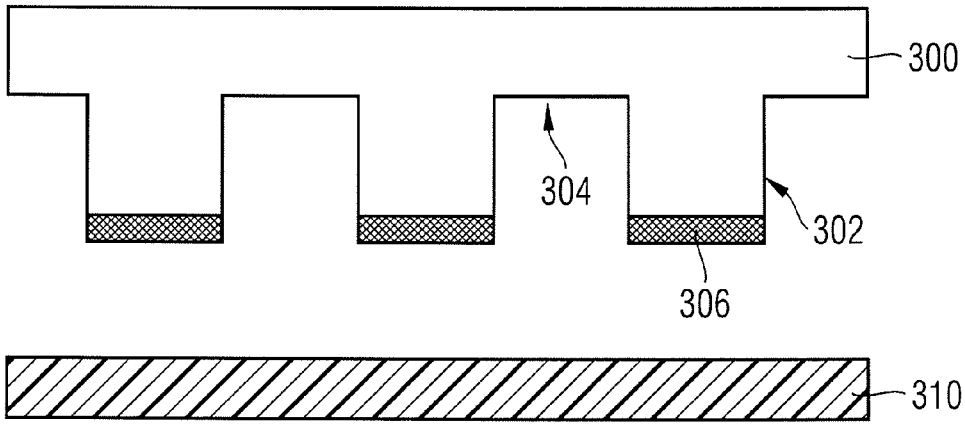
Figure 19B:
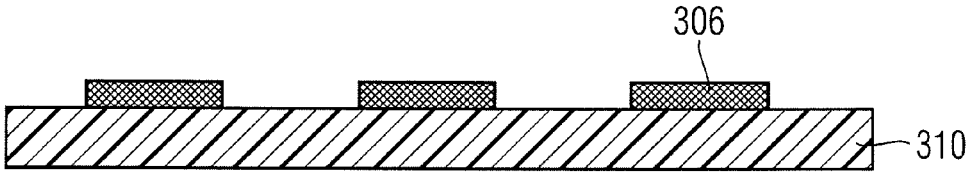

Shown are:

FIG. 1 a schematic diagram of a banknote having an embedded security thread and an affixed transfer element, FIG. 2 in (a) and (b), schematic diagrams to explain the principle of the present invention, FIG. 3 a combination of the invention variants in FIGS. 2(*a*) and (*b*), FIG. 4 schematically, the layer structure of a moiré magnification arrangement, in cross-section, FIG. 5 an exemplary embodiment in which a microscopic patterning according to the present invention is combined with a conventional macroscopic patterning, FIG. 6 in (a) to (c) intermediate steps in the manufacture of a colored moiré magnification arrangement that is combined in register with a metalization, FIG. 7 in (a) to (d), intermediate steps in the manufacture of a moiré magnification arrangement that is combined with a hologram, FIG. 8 a two-color micropattern according to a further exemplary embodiment of the present invention, FIG. 9 in (a) to (e), intermediate steps in the manufacture of a security element having two different holograms that are visible from opposing sides and that exhibit a common and thus perfectly registered negative pattern, FIG. 10 a moiré magnification arrangement to whose lens array an adhesive layer is transferred with a method according to the present invention, FIG. 11-13 in each case, embedded in paper, a window security thread according to an exemplary embodiment of the present invention, FIG. 14 in (a) and (b), intermediate steps in the manufacture of a further micropattern according to the present invention, FIG. 15 in (a) and (b), intermediate steps in the manufacture of an inventive micropattern having reverse-side effects, FIG. 16 in (a) and (b), intermediate steps in the manufacture of a micropattern according to the present invention, having two different holograms that are visible from opposing sides, FIG. 17 in (a) to (c), intermediate steps in the manufacture of an inventive micro-optical magnification arrangement having colored metallic micropatterns, FIG. 18 in (a) to (c), intermediate steps in the manufacture of further metalized micropatterns according to the present invention, and FIG. 19 in (a) and (b), the use of a micropattern according to the present invention for producing a high-resolution printing layer on a target substrate.

The invention will now be explained using the example of security elements for banknotes. For this, FIG. 1 shows a schematic diagram of a banknote 10 that is provided with two security elements 12 and 16 according to exemplary embodiments of the present invention. Here, the first security element constitutes a security thread 12 that emerges in certain window regions 14 at the surface of the banknote 10, while it is embedded in the interior of the banknote 10 in the regions lying therebetween. The second security element 16 is formed by an affixed transfer element of arbitrary shape. In other embodiments, the security element 16 can also be developed in the form of a cover foil that is arranged in or over a window region or a through opening in the banknote.

First, the principle of the present invention will be explained with reference to the schematic diagrams in FIG. 2. Thereafter, by way of example, some specific exemplary embodiments of security elements according to the present invention are described with reference to the further figures.

The security element 20 shown in FIGS. 2(*a*) and (*b*) includes as the substrate foil 22 a transparent PET foil, for example. To the top of the substrate foil 22 is applied, in each case, a UV-curing embossing coating layer 24 in which an embossing pattern having elevations 26 and depressions 28 in the form of a desired micropattern is embossed.

For the present invention, the type of micropattern is only of secondary importance. For example, the micropatterns that may be considered can be micro-optical magnification arrangements, such as moiré magnification arrangements, moiré-type micro-optical magnification arrangements or modulo magnification arrangements, or they can also be other micro-optical patterns, such as blazed grating patterns, DOE (diffractive optical element) patterns, computer-generated holograms (CGH) or other hologram-like diffraction patterns, or they can be microlens patterns or Fresnel-lens-like patterns. The present invention offers particular advantages in high-resolution micropatterns whose micropattern elements are formed having a line width between about 1 μm and about 10 μm and having a pattern depth between about 0.5 μm and about 20 μm. In the present invention, the elevations and depressions of the embossing pattern form, in each case, the micropattern elements of the micropattern, such that the dimensions of the elevations and depressions correspond to those of the micropattern elements.

In order to, in a first variant of the present invention, selectively apply printing ink substantially only onto the elevations 26 of the embossing pattern, the embossing pattern is printed on, for example, in the offset printing process at low pressure with a high-viscosity printing ink 30, as shown in FIG. 2(*a*). Here, especially radiation-curing or heat-curing offset printing inks having a dynamic viscosity between 800 mPa*s and 150 Pa*s at room temperature may be considered. A thin, non-fast-drying ink can be achieved, for example, through rubbing the ink through a system consisting of multiple rotating rollers, readily volatile solvents being able to be dispensed with.

Here, the printing ink 30 is applied in a layer thickness d that is considerably smaller than the depth t of the embossing patterns. The hardness of the printing tool and, if applicable, of a counter roller, and the pressure when transferring the printing ink, are each chosen in accordance with the desired size and depth of the transfer regions 32. The pressure when transferring is especially chosen to be, on the one hand, so low that the printing ink 30 is not crushed, but on the other hand, high enough that ink is transferred in the region of the elevations 26. By setting a higher pressure, the transfer region 32 can also be enlarged. If, for example, there are more than two height levels in an embossing pattern, with not only the uppermost height level undergoing contact with the printing ink 30 in the context of the printing process, then it is possible to transfer different ink amounts depending on the level. Here, the correlation between the pressure and size of the transfer regions is not linear; from a very high-lying level, ink can even be crushed off by pressure.

In a particularly advantageous method variant, the printing ink is transferred to the embossing pattern practically without impression pressure, a defined spacing between the applicator unit and the surface of the embossing pattern being filled by the printing ink at or on the applicator unit.

In the described approach, and given sufficiently low pressure, no contact is made between the high-viscosity printing ink 30 and the depressions 28 of the embossing pattern, such that substantially only the elevations 26 of the micropattern are selectively provided with ink, and a contiguous toning film that is typical of intaglio printing is avoided. As explained in greater detail below, not only printing inks can advantageously be selectively transferred onto the elevations 26 of an embossing pattern with the described method, but also other imprint materials, such as an adhesive or a resist coating.

Embossing patterns can easily be manufactured with the highest precision of the dimensions of their elevations and depressions by per se known methods. Through the selective transfer of the high-viscosity printing ink only onto the elevations of the embossing patterns, the high resolution of the embossing pattern is transferred to the print image, such that a print image having an extraordinarily high resolution can be produced.

With reference to FIG. 2(*b*), according to a second variant of the present invention, printing ink can also be selectively transferred substantially only into the depressions 28 of the embossing pattern. For this, a printing ink 34 of such low viscosity that the printing ink 34 flows into the depressions 28 and leaves the elevations 26 uncovered is applied to the embossing pattern, for example in flexographic printing or intaglio printing. For this, in general, in addition to the choice of viscosity, also the surface tension of the printing ink must be coordinated with the surface energy of the embossing pattern.

For this variant of the present invention, especially dye solutions, pigment dispersions or inks having a viscosity between 3 mPa*s and 1500 mPa*s at room temperature may be considered as the printing inks. Also in this variant of the present invention, in addition to printing inks, advantageously also other low-viscosity imprint materials, such as low-viscosity adhesives or liquid crystal solutions, can be selectively transferred into the depressions 28.

The transferring of the printing ink into the depressions 28 can also occur in two steps. In this case, a low-viscosity printing ink, having a low binder content, that selectively flows into the depressions 28 of the embossing pattern is first transferred. Thereafter, a solution having a high binder content is transferred that fixes the colorant of the printing ink in the depressions 28 of the embossing pattern and subsequently embeds it in a binder matrix.

The selective transfer of the imprint materials onto the elevations or into the depressions according to the first or second variant of the present invention can be further intensified through systematic patterning of the elevations or depressions. For example, the elevations 26 in the variant in FIG. 2(*a*) can be developed having a sharply delimited, high-standing edge region that delimits the raised micropattern elements. In this way, the imprint material transferred onto the elevations 26 is restricted even more strongly to the region of the elevations 26. Here, the high-standing edge region can exhibit, for example, a height of about 1 μm to 2 μm. If applicable, through this measure, the requirements for the viscosity of the imprint material can be reduced.

In the variant in FIG. 2(*b*), the elevations 26 can, for example, additionally be provided with a lotus pattern that produces a lightly crosslinkable elevation surface. The lotus patterns reduce the contact area between the elevations and the transferred imprint material such that said imprint material practically cannot adhere to the surface of the elevations 26 and flows even more lightly into the depressions 28. If applicable, through this measure, the requirements for the viscosity of the imprint material can be reduced.

If a low-viscosity solution of nematic liquid crystals is chosen as the imprint material, the depressions 28 can be provided with alignment patterns for aligning liquid crystal material. Following the removal of the solvent, the aligned nematic liquid crystal material is crosslinked and thus fixed. The birefringent patterns created can be viewed against a suitable reflective background by means of a polarizer, for example through the lens array of a micro-optical magnification arrangement described below. The depicted motif can be further patterned through different alignment directions of the alignment patterns.

To facilitate a particularly even flow of the ink into the depressions 28, it is further appropriate to not let the elevations 26 grow vertically out of the background, but rather to let the depressions 28 transition into the elevations 26 with rounded transitions, as shown in FIG. 2. In this way, it is especially avoided that printing ink 34 accumulates at the transitions between elevations and depressions. Alternatively, before the desired printing ink is transferred, it is also possible for a small amount of low-viscosity clear lacquer that fills up such transitions to be transferred first.

The variants of the present invention in FIGS. 2(*a*) and (*b*) can also be combined with one another, as depicted in FIG. 3. In the security element shown schematically there, in a first step, a first high-viscosity printing ink 30 was selectively applied substantially only onto the elevations 26 of the embossing pattern. In a second step, a second low-viscosity printing ink 34 was then selectively transferred substantially only into the depressions 28 of the embossing pattern. As can be seen in FIG. 3, the micropattern is not leveled or weakened by the coating with the first printing ink 30, such that the selective transfer of the second printing ink 34 can occur as described above.

If the printing inks 30, 34 are suitably coordinated, the first printing step can even improve the suitability of the micropattern for the transfer of the second printing ink 34, for example in that, as the first printing ink, a printing ink 30 is applied that exhibits ink-repellant properties for the second printing ink 34. If the procedure is suitable, the sequence of the printing steps can, in principle, also be reversed and the low-viscosity printing ink first transferred into the depressions and then the high-viscosity printing ink onto the elevations.

All in all, the embodiment in FIG. 3 appears, both when viewed 36 from the top and when viewed 38 from the bottom, having micropatterns of a first color (the color of the first printing ink 30) against the background of a second color (the color of the second printing ink 34).

Since the present invention is explained below using the example of moiré magnification arrangements that exhibit micropatterns composed of a plurality of micromotif elements and microlenses, the operating principle of such moiré magnification arrangements is first briefly described with reference to FIG. 4. The explanation with reference to simple moiré magnification arrangements is not intended to represent any limitation to this type of micro-optical magnification arrangements. Rather, it is understood that the present invention can advantageously be used also for other micro-optical magnification arrangements, especially for the general modulo magnification arrangements, as are described in applications PCT/EP2008/005171 and PCT/EP2008/005172.

FIG. 4 shows schematically the layer structure of a moiré magnification arrangement 40, in cross section, only the portions of the layer structure that are required to explain the functional principle being depicted. The moiré magnification arrangement 40 includes a substrate 42 in the form of a transparent plastic foil, in the exemplary embodiment a polyethylene terephthalate (PET) foil about 20 μm thick. The top of the substrate foil 42 is provided with a grid-shaped arrangement of microlenses 44 that form, on the surface of the substrate foil, a two-dimensional Bravais lattice having a prechosen symmetry. The Bravais lattice can exhibit, for example, a hexagonal lattice symmetry, but due to the higher counterfeit security, lower symmetries, and thus more general shapes, are preferred, especially the symmetry of a parallelogram lattice.

The spacing of adjacent microlenses 44 is preferably chosen to be as small as possible in order to ensure as high an areal coverage as possible and thus a high-contrast depiction. The spherically or aspherically designed microlenses 44 preferably exhibit a diameter between 3 μm and 50 μm, and especially a diameter between merely 10 μm and 35 μm, and are thus not perceptible with the naked eye.

On the bottom of the substrate foil 42, a motif layer 46 is arranged that includes a likewise grid-shaped arrangement of identical micromotif elements 48. Also the arrangement of the micromotif elements 48 forms a two-dimensional Bravais lattice having a prechosen symmetry, a parallelogram lattice again being assumed for illustration.

As indicated in FIG. 4 through the offset of the micromotif elements 48 with respect to the microlenses 44, the Bravais lattice of the micromotif elements 48 differs slightly in its symmetry and/or in the size of its lattice parameters from the Bravais lattice of the microlenses 44 in order to produce a desired moiré magnification effect. Here, the lattice period and the diameter of the micromotif elements 48 are on the same order of magnitude as those of the microlenses 44, so preferably in the range from 3 μm to 50 μm, and especially in the range from 10 μm to 35 μm, such that also the micromotif elements 48 are not perceptible even with the naked eye.

The optical thickness of the substrate foil 42 and the focal length of the microlenses 44 are coordinated with each other such that the micromotif elements 48 are spaced approximately the lens focal length apart. The substrate foil 40 thus forms an optical spacing layer that ensures a desired constant spacing of the microlenses 44 and of the micromotif elements 48. Due to the slightly differing lattice parameters, the viewer sees, when viewing from above through the microlenses 44, a somewhat different sub-region of the micromotif elements 48 each time, such that the plurality of microlenses 44 produces, overall, a magnified image of the micromotif elements 48. Here, the resulting moiré magnification depends on the relative difference between the lattice parameters of the Bravais lattices used. If, for example, the grating periods of two hexagonal lattices differ by 1%, then a 100× moiré magnification results. For a more detailed description of the operating principle and for advantageous arrangements of the micromotif elements and the microlenses, reference is made to publications DE 10 2005 062 132 A1 and WO 2007/076952 A2, the disclosures of which are incorporated herein by reference.

To be able to produce such a moiré magnification arrangement having micromotif elements of different colors and in the required fineness, the method according to the present invention can be combined with a conventional macroscopic patterning, for example by a printing forme. Here, with reference to FIG. 5, an embossing pattern 50 applied to a substrate foil determines, through its micropatterning, which of the only micrometer-sized sub-regions 52 are to be provided with ink and, in this way, form the micromotif elements of a moiré magnification arrangement, and which sub-regions 54 are not to be printed on.

In accordance with the method described in connection with FIG. 2(*a*), for this, the embossing pattern 50 exhibits elevations 56 that are developed in the shape and arrangement of the desired micromotif elements. Embossing patterns can also be manufactured in the high resolution required for the micromotif elements with no problem. Through the transfer of a high-viscosity printing ink 60 to the embossing pattern 50, substantially only the elevations 56, but not the depressions 58, are selectively colored, such that the high resolution of the embossing is transferred to a high-resolution print image.

This high-resolution patterning 52, 54 due to the embossing pattern 50 can now be combined with a low-resolution patterning 62, 64, 66 that is determined, for example, by a printing forme, in order to produce a multicolored moiré magnification arrangement. For this, in each case, high-viscosity printing inks 60 of different colors are transferred onto the elevations 56 in, compared with the micromotif subregions 52, 54, considerably more expansive, macroscopic regions 62, 64, 66. With an appropriate design, the depicted moiré-magnified motif can then migrate from one color region to the next color region when the finished moiré magnification arrangement is tilted.

Since an exact printing of inks next to one another is often difficult, advantageously, embodiments are used in which a mixed-color region 64 is provided between two desired color regions 62, 66. For example, between a motif region 62 printed on with blue printing ink and a motif region 66 printed on with yellow printing ink, an in-between region 64 printed on with green printing ink can be provided. Such an approach is appropriate especially for low-opacity inks. For high-opacity inks, also the smallest color region can be printed first, then the next larger one, until finally a contiguous area is applied. The sequence of the printing layers is reversed, of course, if the lens array of the moiré magnification arrangement is not, as depicted in FIG. 4, to be on the opposing side of the substrate, but rather is applied to the print side, which is likewise possible.

When printing multiple at least partially opacifying ink layers, a multicoloredness of the moiré magnification arrangement results that conveys, when viewed from above or from below, a different color impression in each case. This different color impression can be made more highly visible by applying lens arrays on both sides of the arrangement.

Instead of two colors, also a combination of a color and a metal layer can be used. Also a combination of two colors and a metal layer lying therebetween may be considered, as described below in greater detail. The metal layer can also be produced through oblique evaporation of the relief pattern, such that, if the evaporation angle is suitably coordinated, a demetalization to expose the depressions can be dispensed with. If, for example, no suitable offset ink having resist properties is available, the desired effect can also be obtained by suitable oblique evaporation of the relief pattern without demetalization.

In the exemplary embodiments described below, to improve the diagram clarity, the elevations and depressions of the micropatterns are always depicted as rectangular patterns. However, it is understood that the elevations and depressions can always be rounded, or be provided with continuous transitions and/or with additional patterns, as explained above. Also, always only the embossing pattern and the layers required for the explanation are shown, and other elements of the structure, such as substrate foils, adhesive and protection layers or the lens arrays of the moiré magnification arrangements, are omitted. Also, all elevation/depression patterns can, for example, be filled with a clear lacquer in order to protect the printed elevations and depressions against undesired filling up with dirt and against manipulation or castings.

FIG. 6 shows an exemplary embodiment in which a colored micropattern, for example a colored moiré magnification arrangement, is combined in register with a metalization. To achieve this registration, an embossing pattern 70 is first produced, having elevations 72 and depressions 74 that form the pattern elements of the desired micropattern. The embossing pattern 70 is then contiguously provided with a metalization 76, as shown in FIG. 6(*a*). Then, to the metalization 76 is applied a colored, high-viscosity resist coating 78 that selectively covers, in the manner described above, substantially only the elevations 72 of the embossing pattern 70, as shown in FIG. 6(*b*). Thereafter, the pattern that is embossed, metalized and provided with resist coating is demetalized in a per se known manner, for example by means of a leach. As depicted in FIG. 6(*c*), here, the metalization 76 is preserved on the elevations 72 that are protected by resist coating 78, while the metalization 76 is removed in the depressions 74.

In this way, a micropattern that is observable on both sides is created having a perfectly registered visual appearance. When viewed 80 from above, the micropattern appears having the color impression of the resist coating 78, and when viewed 82 from below, having the metallic gloss of the metal layer 76. If the elevations and depressions form the micromotif elements of a moiré magnification arrangement, then, to both sides of the micropattern can be applied one lens array each through which the colored (viewing direction 80) or metallic (viewing direction 82) micromotif elements are visible moiré magnified. In both appearances, the demetalized regions of the depressions 74 constitute congruent gaps that can be developed in the form of an inverse lettering or in the form of arbitrary other patterns, characters or codes.

If desired, the resist coating 78 can also be removed after the demetalization. The micropattern then appears from both sides having the metallic impression of the metalization 76 and having perfectly registered gaps 74. If, in this or also other exemplary embodiments, larger continuous demetalization areas are provided in the micropattern, then, preferably, before the metalization, a soluble washable ink is applied to the embossing pattern in the form of the desired demetalization regions, and the washable ink, together with the metalization, is washed off by a solvent before the resist coating is transferred.

Through a suitable design of the embossing pattern, the micropattern formed by the elevations and depressions can be combined with a further micro-optical pattern. For example, a moiré magnification arrangement can be combined with a hologram, as now explained with reference to the exemplary embodiment in FIG. 7.

FIG. 7 shows an embossing pattern 90 having elevations 92 and depressions 94 that, in their shape and arrangement, form the micromotif elements of a moiré magnification arrangement. In addition, the surfaces of the elevations 92 are provided with diffractive microrelief patterns 96 that bear a desired piece of holographic information. The depressions 94 of the embossing pattern, in contrast, include no optically relevant information.

The embossing pattern 90 is first contiguously provided with a metalization 98, as shown in FIG. 7(*a*). Then, to the metalization 98 is applied a high-viscosity resist coating 100 that selectively covers, in the manner described, substantially only the elevations 92 of the embossing pattern 90, as shown in FIG. 7(*b*). Thereafter, the embossed, metalized pattern provided with resist coating is demetalized and the resist coating 100 removed. In this way, as shown in FIG. 7(*c*), the metalization 98 is retained on the elevations 92 provided with the microrelief patterns 96, while the depressions 94 are demetalized.

Through this approach is created, on the one hand, a moiré magnification arrangement having a metallic appearance and whose micromotif elements are formed by the shape and arrangement of the depressions 92 and elevations 94. In addition, the arrangement includes a hologram that is encoded only in the raised regions 96 of the embossing pattern 90. However, since the dimensions of the elevations 92 and depressions 94 are below the resolution limit of the human eye, it is not perceptible for the viewer that the piece of holographic information 96 is present only on the elevations 92, such that the holographic image is perceived by the viewer as a contiguous image.

In an alternative method variant, a high-viscosity resist coating 100 of a desired color is applied to the embossing pattern and, after the demetalization, a removal of the resist coating 100 dispensed with, such that the embossing pattern shown in FIG. 7(*d*) is created. If the resist coating layer 100 is developed to be opacifying, then, in this embodiment, a colored moiré magnification arrangement is perceptible when viewed 102 from above, and the hologram of the microrelief patterns 96 when viewed 104 from below.

If the resist coating layer 100 is developed to be sheer, or if, as shown in FIG. 7(*c*), a sheer, high-viscosity ink layer is imprinted on the elevations 92 after the removal of the resist coating, then, in addition to the colored moiré magnification arrangement, also the sheer hologram of the microrelief patterns 96 is perceptible when viewed 102 from above.

With reference to FIG. 8, an unambiguously two-colored micropattern can be produced, for example, in that, in a first step, a first high-viscosity printing ink 110 is selectively applied to the elevations 72 of an embossing layer 70, the printed embossing layer is provided with a contiguous metalization 112, and then a colored, high-viscosity resist coating 114 is selectively applied to the elevations 72 of the metalized embossing layer. After the demetalization, the micropattern shown in FIG. 8 results that appears having the color impression of the colored resist coating 114 when viewed 116 from above, and that appears having the color impression of the first printing ink 110 when viewed 118 from below. The depressions 74 form congruent gaps from both viewing directions. If desired, one or both ink layers 110, 114 can be developed to be sheer, such that the metalization 112 remains visible through the ink layers. In this case, the elevations 72 can also be provided with diffractive microrelief patterns, as described in connection with FIG. 7, in order to create a combination of the two-colored micropattern having a hologram or another micro-optical pattern.

With an alternative manufacturing variant, such an unambiguously two-colored micropattern can also be produced without a demetalization step. For this, the printed embossing layer 70, 110 is evaporated at an oblique angle with metal, such that the metalization 112 is present only on the elevations 72 and a flanking side of the elevations 72. For a suitably chosen evaporation angle, the depressions 74 are shaded by the elevations 72, such that no metal settles there. Thereafter, a further colored coating 114 is selectively applied to the elevations 72, such that the desired color impression is created without demetalization.

FIG. 9 shows, as a further exemplary embodiment of the present invention, a security element 120 having two different holograms that are visible from opposing sides and that exhibit a shared, perfectly registered negative pattern, for example an inverse lettering.

To manufacture such a security element 120, first, an embossing pattern having elevations 122 and depressions 124 is produced in the form of a desired micropattern.

Here, the surfaces of the elevations 122 are provided with diffractive microrelief patterns 126 that bear the piece of holographic information of the second hologram that is later visible from below 140. The depressions 124 include no optically relevant information, but rather, they constitute the later inverse lettering regions.

The embossing pattern is then contiguously provided with a metalization 128, as shown in FIG. 9(*a*). To the metalization 128 is applied a high-viscosity thermoplastic resist coating 130 that selectively covers, in the manner described, substantially only the elevations 122 of the embossing pattern. The thermoplastic resist coating 130 is provided with an embossing in the form of diffractive microrelief patterns 132 that bear the piece of holographic information of the first hologram that is later visible from above 138, as shown in FIG. 9(*b*).

The pattern obtained in this way is provided anew with a contiguous metalization 134, as shown in FIG. 9(*c*), and the elevations 122 of the embossing pattern are coated anew with a high-viscosity resist coating 136, as shown in FIG. 9(*d*). Through a demetalization step, both metalizations 128, 134 are then ablated in the region of the depressions 124. Thereafter, the resist coating 136 is removed from the elevations 122 in order to obtain the double-sided hologram pattern shown in FIG. 9(*e*).

When the micropattern is viewed 138 from above, the first hologram formed by the diffractive microrelief patterns 132 is visible, and when viewed 140 from below, the durch the second hologram formed by the diffractive microrelief patterns 126. Both holograms include a common, congruent negative piece of information that is formed by the depressions 124. If desired, a further high-viscosity printing ink can be transferred onto the elevations 122 to have the first hologram appear colored when viewed 138 from the top.

Instead of embossing a thermoplastic resist coating 130, as described for FIG. 9(*b*), after the application of a resist coating 130, also a first demetalization step can occur that removes the metalization 128 in the region of the depressions 124. Then a thin, contiguous embossing coating layer is applied that follows the arrangement of the elevations 122 and depressions 124. This embossing coating layer is then provided with diffractive microrelief patterns 132 that bear the piece of holographic information of the first hologram that is later visible from above. A renewed contiguous metalization 134, application of a high-viscosity resist coating 136 onto the elevations 122 and renewed demetalization follow. Also in this approach, a security element is created that exhibits two holograms that are each visible from opposing sides and that have congruent negative pieces of information in the region of the depressions 134, with, however, an additional demetalization step being required compared with the method in FIG. 9.

Instead of a printing ink or a resist coating, also other imprint materials, such as an adhesive, can be selectively transferred onto the elevations or into the depressions of a micropattern without leveling the specified micropatterns.

With reference to FIG. 10, for a moiré magnification arrangement 40, the microlenses 44 of a lens array, for example, can be provided with an adhesive layer 150 in the manner described. For this, the heat seal coating to be transferred must be set to be highly viscous and be non-blocking at room temperature. In addition to conventional, aqueous-based systems, the heat seal coating can also be, for example, a water-activatable adhesive system that is activated by the moisture in the paper machine. Through this measure, a security thread, for example, having a moiré magnification arrangement and embedded in a paper substrate can be joined with the paper via an adhesive layer not only on the side of the motif layer, but also on the side of the lens array. In conventional embodiments, in contrast, the side of the microlenses always remains open, which leads to a weaker anchoring of the security thread. It is understood that the additional adhesive layer 150, with its refractive index, can already be suitably taken into account in the design of the geometry and refractive index of the microlenses 44. Of course adhesive material can also be selectively applied to the raised sites of an embossing pattern on the motif side of a moiré magnification arrangement 40.

FIG. 11 illustrates a further possibility to embed, in paper 182, a security thread, especially a window security thread 180, having a micro-optical magnification arrangement. One disadvantage of conventional security threads having micro-optical magnification arrangements consists in a poor embedding in the paper. For a good embedding, it is desirable to furnish the security threads on both their top and their bottom with an adhesive that ensures that the security thread is well attached to the paper. This is especially important with window security threads, since with these, the paper 182 overlies the security thread in the form of window bars 183. These window bars 183 exhibit a length of several millimeters to up to about 20 mm.

If the top of a security thread is now not coated with adhesive, then the paper bar overlies the security thread without an adhesive connection. In circulation, a gap can form between the thread top and the paper bar that can lead to the tearing or tearing off of the paper bar and thus to strongly visible and undesired changes in the embedding value document. In banknotes, such security threads that are not glued in also tend to allow the paper to tear in the region of the security thread, such that, at the edge of the note, the security thread that is actually embedded there becomes visible.

In the currently known security threads having micro-optical magnification arrangements, the thread top can now not be coated with adhesive, since the adhesive would level the topography of the lens grid and, due to the similar refractive indices of the adhesive and the lens material, destroy the focusing effect of the lenses.

According to the present invention, however, in a micro-optical magnification arrangement 40 having microlenses 44, high-viscosity adhesive 184 can be selectively applied only to the upper regions of the microlenses 44 and then a laminating foil 186 can be laminated onto the microlens array 44. For embedding in paper 182, 183, both the thread bottom and the thread top can then each be provided with an adhesive layer 188, as shown in FIG. 11.

Since the adhesive 184 covers only the uppermost region of the microlenses 44, a plurality of microcavities 185 is created between the laminating foil 186 and the microlens array 44, away from the adhesive regions. The microcavities 185 are filled with air (n=1) and thus exhibit a large refractive index difference to the material of the microlenses (n≈1.5), such that the focusing effect of the microlenses 44 is substantially preserved despite the foil 186 being laminated onto them. In the uppermost regions of the microlenses 44, in which the laminating foil 186 is joined with the lenses via the adhesive 184, the beam path through the lens is substantially vertical when viewed anyway, such that the optical effect of the lenses there is practically not impaired by the adhesive 184. This applies especially for both lenses in the shape of spherical caps and for lenticular lenses.

It is possible to use the principle illustrated in FIG. 11 not only with the microlenses of micro-optical magnification arrangements, but advantageously generally with unmetalized, optically variable micropatterns. While the optically variable effect of metalized micropatterns is generally little influenced by covering with lacquers or over-laminating with a foil, an optically variable effect of unmetalized micropatterns is normally lost through covering with lacquer or gluing with a foil. This is due primarily to the fact that the refractive indices of typical micropattern materials, for example of an embossing coating layer, and typical adhesives are almost always close to each another. The surrounding adhesive then prevents an effective light deflection by the micropatterns and thus the desired refractive or optically variable effect.

With reference to FIG. 12, a window security thread 190 exhibits a substrate 192 and an unmetalized relief pattern 194 that forms an optically variable micropattern. For illustration, in FIG. 12, the relief pattern is depicted in the form of a blaze lattice 194, but the present invention is also applicable for arbitrary other unmetalized relief patterns. To the elevations of the relief pattern 194, so here the uppermost region of the blaze lattice elements, is selectively applied, in the manner described above, a high-viscosity adhesive 196. Then, as already described in connection with FIG. 11, a laminating foil 186 is laminated onto the optically variable micropattern 194 and the security thread 190 is securely embedded in the paper 182, 183 via adhesive layers 188 applied on the top and bottom.

Since the adhesive 196 covers only the uppermost region of the blaze lattice elements 194, a plurality of air-filled microcavities 195 is created between the laminating foil 186 and the optically variable micropattern. The blaze lattice elements are thus located in air atmosphere having a large refractive index difference, so that their optically variable effect is substantially preserved despite the lamination of the foil 186.

In a modification of the embodiments in FIGS. 11 and 12, the micropattern is systematically designed with a view to the later lamination of a foil. For this, the micropattern also includes, in addition to the useful elevations and useful depressions that produce the desired optical effect, supporting elevations without an optical effect that serve merely the bonding with the laminating foil. For illustration, FIG. 13 shows a window security thread 200 having a micro-optical magnification arrangement 202 that, except for the additionally provided supporting embossings 204 in the plane of the lens array, corresponds to the micro-optical magnification arrangement 40 in FIG. 11.

When embossing the microlenses 44, for this, in addition to the optically effective microlenses 44, regularly arranged supporting columns 204 are embossed in the embossing coating layer that themselves exhibit no optical effect, but that project so far above the microlenses 44 that, when transferring the adhesive 206 to the embossing pattern 44, 204, only the supporting columns 204, but not the microlenses 44, come into contact with the adhesive 206. The microlenses 44 thus remain completely in air atmosphere 208 also after the bonding of the embossing pattern 44, 204 with the laminating foil 186 and maintain their optical effect undisturbed.

This variant of the present invention can, of course, be used not only in micro-optical magnification arrangements, but generally in optically variable micropatterns. Particularly good results are achieved in optically variable embossing patterns whose optically effective embossing pattern elements (useful elevations) are not too high. The useful elevations are preferably not higher than 10 μm, particularly preferably not higher than 5 μm.

For example, the embossing pattern can include, as optically effective elements (useful elevations), diffractive optical elements that, when transilluminated with a laser beam, project a specified image on a screen. Here, the patterns of the diffractive optical elements typically exhibit lateral dimensions of 0.5 μm to 30 μm and a height of barely more than 1 μm. Without supporting elevations according to the present invention, these embossing pattern elements are too thin for a covering with a foil, since the required adhesive would run into the spaces between the embossing pattern elements and destroy their optical effect. In contrast, by providing additional supporting elevations, a desired air-filled spacing can be produced in a controlled manner between the useful elevations and the laminating foil.

The shape and area coverage of the supporting elevations can vary in broad ranges. The supporting elevations can be developed, for example, in the form of columns or bars in a regular or irregular arrangement.

A further possibility to systematically develop the micropattern with a view to the later lamination of a foil consists in providing the micropattern elements, in their uppermost regions, with small recesses that are intended to receive adhesive drops. The recesses are especially designed such that, through the transfer of small adhesive drops, the complete form of the micropattern elements is restored. For example, in the uppermost regions of the microlenses 44 in FIG. 11, small indentations can be provided that, by receiving adhesive drops, are supplemented to form a complete lens form.

Although not part of the present invention, it is in principle also possible to modify the embodiments in FIGS. 11 to 13 in that, not the uppermost region of the relief pattern is provided with adhesive, but rather in that the laminating foil is coated very thinly with adhesive and in that the micropattern is coated with a laminating foil prepared in this way. Here, the adhesive layer must be so thin or must be so little melted or deformed that it covers only the uppermost regions of the micropattern, such that air-filled microcavities are created between the laminating foil and the micropattern.

The transfer of an adhesive onto the elevations of an embossing pattern also permits, for example, the addition of additional holographic patterns, as explained with reference to the exemplary embodiment in FIG. 14. FIG. 14 shows an embossing pattern 160 having elevations 162 and depressions 164 that, in their shape and arrangement, form a desired micropattern. As in the exemplary embodiment in FIGS. 7 and 9, the surfaces of the elevations 162 are provided with diffractive microrelief patterns 166 that bear a desired piece of holographic information, while the depressions 164 include no optically relevant information. As likewise already described above, the elevations 162 of the embossing pattern 160 were selectively provided with a metalization 168, as shown in FIG. 14(*a*).

In order to now apply additional holographic patterns, a high-viscosity pressure-sensitive adhesive 170 is selectively transferred onto the elevations 162. The embossing pattern 160 prepared in this way is then brought into contact with a further foil 172 that bears a metalized, continuous hologram 174 that is developed to be release-capable. Through suitable setting of temperature and pressure, the holographic patterns 174 of the foil 170 is selectively transferred to the adhesive-bearing elevations 162 of the embossing pattern 160. Also in this way can be created a security element having two holograms that are visible from opposing sides and that exhibit a common, perfectly registered negative pattern 164. If desired, yet a further high-viscosity printing ink can be transferred onto the elevations 162 to have the hologram 174 appear colored when viewed from above.

Further possibilities to provide the micropattern with additional optical effects will now be illustrated with reference to FIGS. 15 and 16, using the example of motif images of micro-optical magnification arrangements. Conventional micro-optical magnification arrangements often exhibit the disadvantage that they are without optical effect from the reverse, or that the application of, for instance, a reflective reverse-side hologram clearly visibly influences and disturbs the front view.

FIG. 15(*a*) shows an embossing pattern 212 that is present on a first substrate foil 210 and that has elevations 214 and depressions 216 that, in their shape and arrangement, form the motif image of a micro-optical magnification arrangement. The surface of the elevations can be left transparent or be selectively coated with an ink 218 in the manner described above. In the further course of the manufacturing process, a microlens grid (not shown) for viewing the motif image formed by the embossing pattern 212 is applied in a known manner on the side of the substrate foil 210 opposite the embossing pattern 212.

On a second substrate foil 220, an embossing coating layer 222 that is poorly anchored on the foil 220 is applied, provided with a desired hologram embossing 224, metalized 226 and, if applicable, demetalized in some regions (not shown). Then the metalized hologram foil 220-226 is provided with a thin adhesive coating 228, brought into contact, under pressure, with the first substrate foil 210, and thereafter separated again. Here, the profile depths of the embossing pattern 212 and the layer thickness of the adhesive coating 228 are coordinated with one another in such a way that the contact exists only with the elevations 214 of the embossing pattern 212.

Upon separation of the foils 210, 220, the second substrate foil 220 detaches in the raised contact regions 214 due to the poor anchoring of the embossing coating layer 222, while no transfer takes place in the region of the depressions 216. In this way, the hologram 224 of the second substrate foil 220 is selectively transferred only onto the elevations 214 of the embossing pattern 212, as shown in FIG. 15(*b*).

When viewed from the reverse R of the finished security element, the metalized embossed regions complement each other to form the hologram 224 produced on the second substrate foil 220. Nevertheless, the security element is still strongly light-transmitting since, with the depressions 216, large portions of the first foil 210 are not coated with opaque metal. When viewed from the front V of the finished security element, the moiré or modulo magnification effect of the micro-optical magnification arrangement can thus be seen undisturbed. If the micropatterns are colored 218, then the metalization 226 even intensifies the color effect. The holographic metalized reverse-side image is practically not perceptible when viewed from the front V, since the hologram reconstructed on the reverse is strongly disrupted on the front by the lens grid, which is not depicted in the figure.

Instead of a metalized hologram, also a detachable color-shifting element can be applied on the second substrate foil 220. The color-shifting element can be formed, for example, by a color-shifting thin-film element composed of absorber, dielectric and reflector. In order to produce an identical or different color-shift effect on both sides of the finished security element, also a double-sided thin-film element having the layer sequence absorber1, dielectric1, reflector, dielectric2, absorber2 can be used.

The color-shifting element can further be formed by a pigmented shift color that is detachably applied on the substrate foil 220. In further embodiment variants, the color-shifting element includes one or more liquid crystal layers. For example, a cholesteric liquid crystal layer can be detachably applied to the substrate foil 220, and over that, an absorbent ink layer. In order to produce a color-shift effect on both sides of the security element, a further cholesteric liquid crystal layer can be provided over the absorbent ink layer.

After the bringing-into-contact and detachment of the second substrate foil 220, the color-shifting element likewise remains on the embossing pattern 212 only in the region of the elevations 214, and is selectively transferred to these in this way. From the reverse, the finished security element exhibits a color-shift effect that does not disturb the optical effect that is visible from the front and that does not strongly impair the transparency of the security element. Through the use of double-sided color-shifting elements, a color-shift effect can also be produced on the front without strongly impairing the transparency of the security element.

The described embodiments are especially suitable for micro-optical magnification arrangements that are used for covering see-through regions of value documents. Micro-optical magnification arrangements display a good optical effect both in reflected light and in transmitted light and are thus well suited particularly for applications in value documents having see-through windows. Through the described reverse-side effects, these micro-optical magnification arrangements are further enhanced without disrupting the front-side moiré effect or general modulo effect.

FIG. 16 illustrates a further possibility to produce a security element having two different holograms that are visible from opposing sides and that have a common negative pattern.

For this, with reference to FIG. 16(*a*), an embossing coating layer 232 is applied to a first substrate foil 230 and provided with a first hologram embossing 234. Following a contiguous metalization 236, a patterned resist coating layer 238 whose gaps display the desired common negative pattern is produced in a per se known manner. After the demetalization of the unprotected metal regions, the appearance of the first substrate foil 230 shown in FIG. 16(*a*) results. Here, the patterned resist coating layer 238 constitutes a relief pattern having elevations 240 and depressions 242 within the meaning of the present invention.

Further, on a second substrate foil 250, a poorly anchored embossing coating layer 252 is applied, provided with a desired second hologram embossing 254, metalized 256 and, if applicable, demetalized in some regions (not shown). The metalized second hologram foil 250 is provided with a thin adhesive coating 258, brought into contact, under pressure and, if applicable, the influence of temperature, with the first hologram foil 230 and separated again. Here, the profile depths of the resist coating layer 238 and the layer thickness of the adhesive coating 258 are coordinated with one another in such a way that the contact exists only with the elevations 240 of the resist coating layer 238.

Upon separation of the hologram foils 230, 250, the second hologram foil 250 detaches in the raised contact regions 240 due to the poor anchoring of the embossing coating layer 252, while no transfer takes place in the region of the depressions 242. In this way, the second hologram is selectively transferred only onto the elevations 240 of the resist coating layer 238, as shown in FIG. 16(*b*). The depressions 242 form a common, perfectly registered negative pattern for the two holograms 236 and 256 that are visible from opposing sides.

In order to produce micro-optical magnification arrangements having colored metallic micropatterns, also the selective transfer of an imprint material into the depressions of an embossing pattern can be used. With reference to FIG. 17, an embossing pattern 260 includes elevations 262 and depressions 264 having a shape and arrangement that is given by the desired motif image. The embossing pattern 260 is contiguously provided with a metalization 266, for example composed of aluminum, as shown in FIG. 17(*a*).

Then a colored resist coating 268 is selectively introduced into the depressions 264 of the embossing pattern 260 in the manner described above, as shown in FIG. 17(*b*). Thereafter, the embossing pattern that is metalized 266 and provided with resist coating 268 is demetalized, for example by a caustic leach. Here, as shown in FIG. 17(*c*), the metalization 266 is preserved in the depressions 264 that are protected by the colored resist coating 268, while it is removed from the surface of the elevations 262.

Through these measures, a micro-optical magnification arrangement is obtained in which the colored micropatterns are underlaid with metal. The reflective metal leads to a clearly increased luminosity of the colored micropatterns and, in this way, improves the perceptibility of the colored, moiré-magnified target images. Furthermore, the fact that the moiré-magnified target image appears for the viewer having colorless, black patterns in transmitted light results as an additional optical effect. The finished security element thus displays a conspicuous reflected light/transmitted light contrast in which the same target image appears once having luminous colors (reflected light) and once as a high-contrast black-and-white image (transmitted light).

In one embodiment, so little colored resist coating 268 is filled into the depressions 264 that it spreads merely into the corner and edge regions around the elevations. The metalization thus does not cover the depressions 264 contiguously, but rather only at the edges of the elevations. In the subsequent etching process, the metalization is then removed not only on the elevations, but also in the uncovered regions in the depressions. In this way, a kind of contour metalization is obtained that surrounds the elevations.

Here, the background can optionally be colored in an additional color in that, for instance, a colored embossing coating, a substrate foil that is colored or printed on in color, colored microlenses, or a further ink layer that is applied after the etching process are used. Instead of into the depressions, the colored resist coating can also be selectively transferred only onto the elevations of the embossing pattern, as already explained in connection with FIG. 6.

With reference to FIG. 18, metalized micropatterns can also be produced with the aid of an adhesive coating that is transferred into the depressions. For this, FIG. 18(*a*) shows an embossing pattern 270 having elevations 272 and depressions 274 having a shape and arrangement that is given by the desired micro-optical motif image. Here, the embossing coating 270 can be colored or colorless. Then, in the manner described above, a colored or colorless, adhesive coating 276 is selectively introduced into the depressions 274 of the embossing pattern 270.

As likewise depicted in FIG. 18(*a*), on a further substrate foil 280 is prepared contiguously or in some regions a metal layer 282 whose adhesion to the substrate foil 280 is weaker than the adhesion to the adhesive coating 276 of the embossing pattern 270. This can be ensured, for example, through the coordination of the materials of the metal layer 282 and of the substrate foil 280, through a pretreatment of the substrate foil 280 or through the use of special release layers between the metal layer 282 and the substrate foil 280.

The substrate foil 280 is then brought into contact, crease-free, under pressure and, if applicable, the influence of temperature, with the filled embossing pattern 270, and thereafter, separated again. Since the adhesion between the metal layer 282 and the adhesive coating 276 surpasses the adhesion between the metal layer 282 and the substrate foil 280, the metal layer in the filled depression regions 274 is selectively transferred to the embossing pattern 270, as shown in FIG. 18(*b*). No transfer takes place in the raised regions 272 of the embossing pattern 270. In this way, metalized micro images or, in the event that the adhesive coating 276 is colored, metalized, colored micro images are produced on the embossing pattern 270.

In an alternative method that is illustrated in FIG. 18(*c*), after the transfer of the colored or colorless, adhesive coating 276, the embossing pattern is first contiguously evaporated with a metal layer 282. In addition, to a substrate foil 290 is applied, contiguously or in some regions, an adhesive layer 292 whose adhesive effect is lower than the adhesive effect of the lacquer 276 that is introduced into the depressions 274. This substrate foil 290 is then brought into contact, crease-free, under pressure and, if applicable, the influence of temperature, with the filled and metalized embossing pattern 270, and thereafter, separated again. At the specified relative adhesive strengths, the metal layer 282 remains on the embossing pattern 270 in the filled depression regions 274, while it is removed by the adhesive layer 292 in the raised regions 272. In this way, as a result, the embodiment shown in FIG. 18(*b*) is created again.

In further variants, after the adhesive coating 276 is transferred, the embossing pattern 270 shown in FIG. 18(*a*) can be dusted with effect pigments, metal pigments or other optically effective particles, with the particles sticking only in the regions 274 of the adhesive coating 276. Alternatively, also an ink having particles that are present without support in the binder matrix can be applied after the drying of the ink. In a further step, the particles are washed off or blown off from the non-adhesive regions 272.

In an alternative embodiment to the designs in FIG. 18, the adhesive coating 276 can also be selectively transferred onto the elevations of the embossing pattern instead of into the depressions. Similar to the approach for the embodiments in FIGS. 18(*a*) and 18(*c*), metal is selectively transferred only onto the elevations.

FIG. 19 shows the use of a micropattern according to the present invention for producing a high-resolution printing layer on a target substrate 310. As illustrated in FIG. 19(*a*), for this is first produced, in the manner described above, a micropattern 300 having elevations 302 and depressions 304, for which a desired imprint material 306 is selectively transferred substantially only onto the elevations 302 of the relief pattern. Due to the high achievable resolution, the elevations 302 and depressions 304 are preferably produced by an embossing process. The imprint material 306 can especially be a printing ink.

Then the micropattern 300 is brought into contact with the target substrate 310, if applicable under pressure and/or the influence of temperature. In this way, the imprint material 306 that is present on the elevations 302 of the relief pattern is transferred to the target substrate 310 with the high resolution determined by the micropattern 300, as shown in FIG. 19(*b*). The target substrate 310 can be suitably pretreated for this purpose.

The invention claimed is:

1. A method for producing a micropattern on a substrate, in which a substrate is provided with a relief pattern that exhibits elevations, flanks, and depressions and in which the elevations, flanks, and depressions are arranged in the form of a desired micropattern, wherein the flanks interconnect the elevations and the depressions; and with a printing tool, an imprint material is transferred to the relief pattern, the viscosity of the imprint material being chosen such that the imprint material is selectively transferred either substantially only onto the elevations or substantially only into the depressions of the relief pattern.

2. The method according to claim 1, characterized in that, with the printing tool, a high-viscosity imprint material is selectively transferred substantially only onto the elevations of the relief pattern.

3. The method according to claim 2, characterized in that the high-viscosity imprint material is transferred in a layer thickness that is smaller than the pattern depth of the relief patterns.

4. The method according to claim 3, characterized in that the layer thickness of the imprint material measures less than 50%, preferably less than 30%, particularly preferably less than 15% of the pattern depth of the relief patterns.

5. The method according to claim 2, characterized in that (a) a desired size and/or depth of transfer regions in which the imprint material is to be transferred onto the elevations of the relief pattern is specified, and in that the hardness of the printing tool and the pressure when transferring the imprint material are chosen in accordance with the desired size and/or depth of the transfer regions, (b) the pressure when transferring the imprint material is chosen to be so low that the imprint material is not crushed, (c) the imprint material is transferred to the relief pattern substantially without pressure, a predetermined spacing between the printing unit and the relief pattern being filled by the imprint material, (d) an imprint material having a viscosity between about 10 mPa*s and about 200 Pa*s, preferably between about 800 mPa*s and about 150 Pa*s at room temperature is chosen, (e) the imprint material is transferred in the offset or flexographic printing method, (f) a printing ink, especially an offset printing ink, is chosen as the imprint material, or (g) a radiation-curing, heat-curing or oxidatively drying printing ink is chosen as the imprint material.

6. The method according to claim 2, characterized in that an adhesive, especially a high-viscosity heat seal coating and/or a water-activatable adhesive system, is chosen as the imprint material.

7. The method according to claim 6, characterized in that, after the adhesive is transferred, the relief pattern is brought into contact with a transfer medium and, in doing so, a transfer material is transferred from the transfer medium to the relief pattern elevations that are provided with adhesive.

8. The method according to claim 7, characterized in that an ink, a colored foil, an effect coating, effect pigments, colored pigments, black pigments, white pigments, dyes, effect layers, a metalization or sub-regions of a hologram or of a hologram-like diffraction pattern or of an optically effective micropattern are chosen as the transfer material.

9. The method according to claim 6, characterized in that, after the adhesive is transferred, the relief pattern is dusted with a transfer material.

10. The method according to claim 9, characterized in that, following the dusting, an excess of the transfer material is removed, especially by a non-contact method.

11. The method according to claim 6, characterized in that, after the adhesive is transferred, a laminating foil is laminated onto the relief pattern.

12. The method according to claim 11, characterized in that the layer sequence having substrate, micropattern and laminating foil is embedded as a security element in a security paper, value document or the like, the substrate and preferably also the laminating foil being provided with an adhesive layer.

13. The method according to claim 2, characterized in that a transfer material provided with an adhesive is transferred onto the elevations of the relief pattern as the imprint material.

14. The method according to claim 13, characterized in that an ink, a colored foil, an effect coating, effect pigments, colored pigments, black pigments, white pigments, dyes, effect layers, a metalization, a sub-region of a hologram or of a hologram-like diffraction pattern or of an optically effective micropattern, or a color-shifting element, especially a color-shifting thin-film element or an element including at least one liquid crystal layer is chosen as the transfer material.

15. The method according to claim 2, characterized in that an effect-pigmented imprint material that exhibits preferably luminescent pigments, thermochromic pigments, metal pigments and/or pearlescent pigments is chosen as the imprint material.

16. The method according to claim 2, characterized in that different high-viscosity imprint materials are transferred, especially imprint materials of different colors or provided with different effect pigments.

17. The method according to claim 2, characterized in that the method includes a step chosen from the group of steps consisting of:

(a) before the desired imprint material is transferred, a high-viscosity lacquer layer is transferred to adjust for sloping edges of the elevations of the relief pattern, (b) the elevations of the relief pattern are developed having a sharply delimited, high-standing edge region, (c) the elevations of the relief pattern are provided with a microrelief pattern, especially with a diffractive microrelief pattern, and (d) combinations thereof.

18. The method according to claim 2, characterized in that a high-viscosity resist coating, especially a colored, high-viscosity resist coating, is chosen as the imprint material.

19. The method according to claim 18, characterized in that the relief pattern is metalized before the high-viscosity resist coating is transferred.

20. The method according to claim 19, characterized in that after the high-viscosity resist coating is transferred, the metalized relief pattern is demetalized in regions that are not protected by resist coating.

21. The method according to claim 20, characterized in that after the demetalization step, the relief pattern is provided with an embossing coating layer, a microrelief pattern, especially a diffractive microrelief pattern, is embossed in the embossing coating layer, the relief pattern is metalized anew, high-viscosity resist coating, especially a colored, high-viscosity resist coating, is transferred anew, and the relief pattern that was metalized anew is demetalized anew in regions that are not protected by resist coating.

22. The method according to claim 19, characterized in that a microrelief pattern, especially a diffractive microrelief pattern, is embossed in the resist coating, the relief pattern is metalized anew, a high-viscosity resist coating is transferred anew, and the relief pattern that was metalized anew is demetalized in regions that are not protected by resist coating.

23. The method according to claim 1, characterized in that the method includes a step chosen from the group of steps consisting of:

(a) the relief pattern is provided with spacing marks for setting a defined spacing and/or pressure when transferring the imprint material, (b) the relief pattern is provided with indicator marks that are measured and registered when transferring the imprint material to control inking and/or pressure, (c) the imprint material is provided with particles of a defined size that prevent a crushing of the imprint material when transferring, and (d) combinations thereof.

24. The method according to claim 1, characterized in that, with the printing tool, an imprint material, especially a low-viscosity imprint material, is selectively transferred substantially only into the depressions of the relief pattern.

25. The method according to claim 24, characterized in that (a) in selecting the low-viscosity imprint material, the surface tension of the imprint material is coordinated with the surface energy of the relief pattern, and/or (b) an imprint material having a viscosity between about 3 mPa*s and about 1500 mPa*s at room temperature is chosen.

26. The method according to claim 24, characterized in that a printing ink, especially a dye solution, a pigment dispersion or an ink is chosen as the imprint material.

27. The method according to claim 24, characterized in that a liquid crystal solution, especially a low-viscosity liquid crystal solution is chosen as the imprint material.

28. The method according to claim 27, characterized in that the depressions of the relief pattern are developed having alignment patterns for aligning liquid crystals.

29. The method according to claim 26, characterized in that, first, a low-viscosity printing ink or liquid crystal solution having a low binder content is transferred that selectively flows into the depressions of the relief pattern, and in that a solution having a high binder content is then transferred that fixes the printing ink or liquid crystal solution in the depressions of the relief pattern.

30. The method according to claim 24, characterized in that a low-viscosity adhesive or a low-viscosity resist coating is chosen as the imprint material.

31. The method according to claim 24, characterized in that a low-viscosity adhesive or a low-viscosity resist coating is chosen as the imprint material, and/or an effect-pigmented imprint material is chosen that preferably exhibits luminescent pigments, thermochromic pigments, metal pigments and/or pearlescent pigments as the imprint material.

32. The method according to claim 24, characterized in that different low-viscosity imprint materials are transferred, especially imprint materials of different colors or provided with different effect pigments.

33. The method according to claim 24, characterized in that (a) the imprint material is transferred in such a small amount that, when transferring, it flows only into the depression edge regions that immediately surround the elevations, or (b) before the desired imprint material is transferred, a low-viscosity clear lacquer that fills the depression edge regions that immediately surround the elevations is transferred in a small amount.

34. The method according to claim 24, characterized in that the depressions are developed having rounded transitions to the elevations and/or the elevations of the relief pattern are provided with a lotus pattern to produce lightly crosslinkable elevation surfaces.

35. The method according to claim 1, characterized in that, in a first step, a first high-viscosity imprint material is selectively transferred substantially only onto the elevations of the relief pattern, and in a second step, a second low-viscosity imprint material is selectively transferred substantially only into the depressions of the relief pattern.

36. The method according to claim 1, characterized in that, through the elevations and depressions of the micropattern, micropattern elements having a line width between about 1 μm and about 10 μm are formed, and/or micropattern elements having a pattern depth between about 0.5 μm and about 20 μm, preferably between about 1 μm and about 10 μm are formed.

37. The method according to claim 1, characterized in that the substrate is provided with an embossing pattern, having elevations and depressions, that forms the relief pattern, or to the substrate is applied a resist coating pattern, having elevations and depressions, that forms the relief pattern.

38. A method for producing a high-resolution printing layer on a target substrate, characterized in that, with the method according to claim 1, a micropattern is produced in which the imprint material is selectively transferred substantially only onto the elevations of the relief pattern, and in that the micropattern thus produced is brought into contact with the target substrate and the imprint material present on the elevations of the relief pattern is transferred to the target substrate.

39. The method of claim 1, wherein the elevations, flanks, and transitions are shaped in a rectangular pattern.

40. The method of claim 39, wherein the elevations within the rectangular patterns have at least one rounded edge transition region such that the elevation includes a flat surface connected, via the at least one rounded edge transition region, to the flanks.

41. The method of claim 39, wherein the depressions within the rectangular patterns include at least one rounded edge transition region such that the depression includes a flat surface connected, via the at least one rounded edge transition region, to the flanks.

* * * * *